US012264846B2

(12) United States Patent
Kim et al.

(10) Patent No.: US 12,264,846 B2
(45) Date of Patent: Apr. 1, 2025

(54) HYGIENE MANAGEMENT DEVICE FOR ENTRANCE HALL

(71) Applicant: LG ELECTRONICS INC., Seoul (KR)

(72) Inventors: Taihong Kim, Seoul (KR); Hyunbyung Cha, Seoul (KR); Hyunsun Yoo, Seoul (KR); Joohyeon Oh, Seoul (KR); Byoungjoonphilip Han, Seoul (KR); Sang Yoon Lee, Seoul (KR); Hyunju Kim, Seoul (KR); Chul Bae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 513 days.

(21) Appl. No.: 17/550,956

(22) Filed: Dec. 14, 2021

(65) Prior Publication Data

US 2022/0186958 A1 Jun. 16, 2022

(30) Foreign Application Priority Data

Dec. 14, 2020 (KR) ..... 10-2020-0174512
Feb. 4, 2021 (KR) ..... 10-2021-0015908

(51) Int. Cl.

| | |
|---|---|
| ***F24F 9/00*** | (2006.01) |
| ***F24F 11/79*** | (2018.01) |
| ***F24F 13/072*** | (2006.01) |
| ***F24F 120/12*** | (2018.01) |

(52) U.S. Cl.

CPC ..... *F24F 9/00* (2013.01); *F24F 11/79* (2018.01); *F24F 13/072* (2013.01); *F24F 2009/007* (2013.01); *F24F 2120/12* (2018.01)

(58) Field of Classification Search

CPC .. F24F 9/00; F24F 11/79; F24F 13/072; F24F 2009/007; F24F 2120/12; A47B 61/04; A47G 25/00; A61L 2/22; A61L 9/14

See application file for complete search history.

(56) References Cited

U.S. PATENT DOCUMENTS

| | | | |
|---|---|---|---|
| 3,068,775 | A | 12/1962 | Zehnder |
| 3,097,587 | A | 7/1963 | Kurek |
| 6,015,342 | A | 1/2000 | Dennis |
| 10,532,119 | B2 | 1/2020 | Dombrowsky et al. |
| 11,083,815 | B1 | 8/2021 | Lee |

(Continued)

FOREIGN PATENT DOCUMENTS

| | | | |
|---|---|---|---|
| CN | 103599900 A | | 2/2014 |
| CN | 204503669 U | * | 7/2015 |
| CN | 207285658 U | | 5/2018 |

(Continued)

*Primary Examiner* — Jorge A Pereiro
*Assistant Examiner* — Michael James Giordano
(74) *Attorney, Agent, or Firm* — Birch, Stewart, Kolasch & Birch, LLP

(57) ABSTRACT

A hygiene management device for an entrance hall includes a fan assembly which generates an air blowing force, a function module which provides a storage space, an air discharger which discharges air toward a person, and an opening/closing unit which selectively stops an air flow. Particularly, the opening/closing unit is configured such that air is supplied into at least one of the function module and a duct unit or simultaneously into both the function module and the duct unit.

16 Claims, 30 Drawing Sheets

(56) References Cited

U.S. PATENT DOCUMENTS

| | | | |
|---|---|---|---|
| 2018/0369434 | A1 | 12/2018 | Callahan |
| 2019/0321503 | A1 | 10/2019 | Warnell |

FOREIGN PATENT DOCUMENTS

| | | | | |
|---|---|---|---|---|
| CN | 207343386 | U | | 5/2018 |
| CN | 108655109 | A | | 10/2018 |
| CN | 111482296 | A | * | 8/2020 |
| JP | 2001-41522 | A | | 2/2001 |
| JP | 4109771 | B2 | | 7/2008 |
| JP | 2011-27270 | A | | 2/2011 |
| KR | 200396409 | Y1 | * | 9/2005 |
| KR | 20-0398514 | Y1 | | 10/2005 |
| KR | 10-2009-0040630 | A | | 4/2009 |
| KR | 20090040630 | A | * | 4/2009 |
| KR | 20100121201 | A | * | 11/2010 |
| KR | 10-1030583 | B1 | | 4/2011 |
| KR | 20180082652 | A | * | 7/2018 |
| KR | 19-2018-0055303 | A | | 5/2019 |
| KR | 20200004169 | A | * | 1/2020 |
| KR | 19-2020-0046715 | A | | 5/2020 |
| KR | 102151990 | B1 | * | 9/2020 |
| KR | 10-2020-0117286 | A | | 10/2020 |

* cited by examiner

HYGIENE MANAGEMENT DEVICE FOR ENTRANCE HALL

CROSS REFERENCE TO RELATED APPLICATIONS

This application claims the priority benefit of Korean Patent Application No. 10-2020-0174512, filed on Dec. 14, 2020 in the Republic of Korea and Korean Patent Application No. 10-2021-0015908, filed on Feb. 4, 2021 in the Republic of Korea, which are hereby incorporated by reference in their entirety for all purposes as if fully set forth herein.

BACKGROUND OF THE INVENTION

1. Field of the Invention

The present disclosure relates to a device provided to manage the hygiene of a person who goes in and out of an entrance hall.

2. Description of the Background Art

Generally, an entrance hall is located between the outside and a specific indoor space to be connected to each other by the entrance hall. That is, a person is required to go through the entrance hall to enter the indoor space from the outside or to go out to the outside from the indoor space.

A vestibule is provided at the inner side of such an entrance hall, and the preparation or maintenance of the vestibule is performed for a person going out of or in the vestibule.

Meanwhile, to prevent outdoor contaminants from being introduced into the indoor space, the contaminants of a person are preferably removed from outside of the vestibule or in the vestibule.

In addition, in the technology disclosed in Korean Patent Application Publication No. 10-2009-0040630 (Patent Document 1), air is showered on a person to remove contaminants, such as dust on the clothing of a person.

In addition, in the technology disclosed in Korean Patent Application Publication No. 10-2020-0117286 (Patent Document 2), in addition to the air shower, a photocatalytic lamp is installed on a ceiling to simultaneously remove contaminants, such as dust, and harmful substances, such as viruses, on the clothing of a person.

Furthermore, in the technology disclosed in Korean Patent Application Publication No. 10-2020-0046715 (Patent Document 3), a lighting fixture and an air cleaning system are integrated with each other such that contaminants are removed from a person in an entrance space such as a vestibule.

Additionally, in the technology disclosed in Korean Patent Application Publication No. 10-2019-0055303 (Patent Document 4), a shower booth having a predetermined shower space thereinside is separately installed, such that a person can remove contaminants in the shower booth.

However, in the related technologies described above, even if decontamination of a person is performed, contaminants remain on some parts of the person's clothes. In consideration of this, when the person wearing contaminated clothes enters an indoor space, the contaminants are inevitably introduced into the indoor space.

In addition, a shoe cabinet is provided on one side wall of the entrance space (for example, a vestibule) of a house.

However, the shoe cabinet is used only for storing shoes and does not manage the shoes.

Of course, recently, a shoe cabinet or shoe management device having various structures for managing shoes has been proposed.

However, such a shoe cabinet for managing shoes is provided separately from a device for the hygiene management of a person.

Accordingly, each of the devices does not share each other's functions and operates individually, so it is difficult to simultaneously satisfy both shoe management and the hygiene management of a person.

DOCUMENTS OF RELATED ART (Patent Document 1) Korean Patent Application Publication No. 10-2009-0040630
(Patent Document 2) Korean Patent Application Publication No. 10-2020-0117286
(Patent Document 3) Korean Patent Application Publication No. 10-2020-0046715
(Patent Document 4) Korean Patent Application Publication No. 10-2019-0055303

SUMMARY OF THE INVENTION

Accordingly, the present disclosure has been made to solve the above problems occurring in the related art.

The present disclosure is intended to propose a hygiene management device in which the decontamination of a person's belongings, such as clothing and shoes, is performed separately from the decontamination of the person's body, such that contaminants are prevented from being introduced into an indoor space when the person enters the indoor space.

In addition, the present disclosure is intended to propose a hygiene management device in which a function module is provided for managing clothes and shoes, and air is circulated into the function module.

In addition, the present disclosure is intended to propose a hygiene management device in which a disinfectant is supplied into the function module such that clothes or shoes stored in the function module are sterilized.

In addition, the present disclosure is intended to propose a hygiene management device in which air discharged toward a person from the upper side of the entrance space is selectively supplied into the function module.

In order to achieve the above objectives, in a hygiene management device for an entrance hall of the present disclosure, an inflow path configured to receive air from a duct unit may be formed in the function module provided on a side wall of an entrance space.

In addition, in the hygiene management device for an entrance hall of the present disclosure, an opening/closing unit configured to selectively close an air flow may be provided in at least one of the function module and the duct unit.

In addition, in the hygiene management device for an entrance hall of the present disclosure, the front surface of the function module may be configured to be open to the inside of the entrance space.

In addition, in the hygiene management device for an entrance hall of the present disclosure, an opening/closing door may be provided on the front surface of the function module.

In addition, in the hygiene management device for an entrance hall of the present disclosure, a disinfectant discharge nozzle for discharging a disinfectant may be provided on the inner surface of the function module.

In addition, in the hygiene management device for an entrance hall of the present disclosure, the disinfectant discharge nozzle may be configured such that a discharge angle thereof is adjusted.

In addition, in the hygiene management device for an entrance hall of the present disclosure, a distance sensor which measures a distance between the disinfectant discharge nozzle and a stored item (e.g., item stored in the storage space) may be provided on the inner surface of the function module.

In addition, in the hygiene management device for an entrance hall of the present disclosure, the disinfectant discharge nozzle may be configured to receive a disinfectant stored in a disinfectant storage tank.

In addition, in the hygiene management device for an entrance hall of the present disclosure, a disinfectant stored in the disinfectant storage tank may be hypochlorous acid water.

In addition, in the hygiene management device for an entrance hall of the present disclosure, two electrode plates having poles different from each other for generating hypochlorous acid water may be provided in the disinfectant storage tank.

In addition, in the hygiene management device for an entrance hall of the present disclosure, introduction flow paths may be formed in a footrest, such that air introduced into the footrest through the surface of the footrest from the inside of the entrance space flows.

In addition, in the hygiene management device for an entrance hall of the present disclosure, an air management module which guides air to be introduced to a fan assembly may be provided at an air introduction side of the fan assembly.

In addition, in the hygiene management device for an entrance hall of the present disclosure, the air management module may be provided with at least one filter.

In addition, in the hygiene management device for an entrance hall of the present disclosure, the fan assembly may be located at a side lower than the function module. That is, the fan assembly may be disposed lower than the function module and at a side of the hygiene management device.

In addition, in the hygiene management device for an entrance hall of the present disclosure, a lower end of the duct unit may be connected to the fan assembly, and an upper end of the duct unit may be connected past the function module to an air discharger.

In addition, in the hygiene management device for an entrance hall of the present disclosure, the air inlet of the inflow path may be formed through the wall surface of the function module so as to communicate with the inside of the duct unit.

In addition, in the hygiene management device for an entrance hall of the present disclosure, the duct unit may be installed along the rear surface of the function module facing the side wall of the inside of the entrance space.

In addition, in the hygiene management device for an entrance hall of the present disclosure, an air outlet of the inflow path may be formed in the bottom surface of the inside of the function module.

In addition, in the hygiene management device for an entrance hall of the present disclosure, the rear edge of the inside of the function module may be configured to be inclined such that the rear edge is located at a position higher than the bottom surface of the inside of the function module.

In addition, in the hygiene management device for an entrance hall of the present disclosure, the opening/closing unit may be located in the duct unit and include a first shutter configured to open/close the duct unit.

In addition, in the hygiene management device for an entrance hall of the present disclosure, a first shutter may be located in the communication portion of the duct unit with the inflow path.

In addition, in the hygiene management device for an entrance hall of the present disclosure, the first shutter may operate to completely close the duct unit or to open only at least a portion of the duct unit.

In addition, in the hygiene management device for an entrance hall of the present disclosure, the first shutter may operate to open both the duct unit and the inflow path.

In addition, in the hygiene management device for an entrance hall of the present disclosure, the first shutter may operate to open only the inflow path.

In addition, in the hygiene management device for an entrance hall of the present disclosure, the first shutter may be configured such that air flowing through the duct unit is guided to the air inlet of the inflow path.

The hygiene management device for an entrance hall of the present disclosure described above may have at least one of the following effects.

The hygiene management device for an entrance hall of the present disclosure may be configured such that air of the duct unit is supplied into the function module for managing clothes or shoes, so it is possible to maintain the hygiene of clothing, such as a person's coat. That is, a person may fundamentally prevent an indoor space from being contaminated by contaminants remaining on the person's coat by keeping the coat in the function module.

In addition, in the hygiene management device for an entrance hall of the present disclosure, air may be selectively supplied to at least one of the function module and the duct unit. Accordingly, air may be selectively supplied into an entrance space or the function module according to various situations. For example, when a person is not present in the entrance space, it is possible to supply air only into the function module.

In addition, in the hygiene management device for an entrance hall of the present disclosure, a disinfectant may be discharged to clothes stored in the function module. Accordingly, hygiene management may be performed without bringing the clothes stored in the function module into an indoor space, and thus the indoor space may be prevented from being contaminated by contaminants remaining on the clothes.

In addition, in the hygiene management device for an entrance hall of the present disclosure, the angle of a disinfectant discharged to clothes may be adjusted. Accordingly, the disinfectant may be discharged to the entire portion of the clothes.

In addition, in the hygiene management device for an entrance hall of the present disclosure, a disinfectant may be stored in the disinfectant storage tank. Accordingly, a disinfectant may be refilled in the disinfectant storage tank according to a user's needs.

In addition, in the hygiene management device for an entrance hall of the present disclosure, the disinfectant storage tank may be installed in a filter housing. Accordingly, the disinfectant storage tank may be taken out from the disinfectant storage tank according to the user's need.

In addition, in the hygiene management device for an entrance hall of the present disclosure, the air management module may be located at the air introduction side of the fan assembly. Accordingly, foreign matter may be removed from air circulating through the insides of the entrance space and the function module. That is, the air from which the foreign matter has been removed may be supplied into a person or the function module, thereby preventing the recontamination of the air due to the supply of contaminated air.

In addition, the hygiene management device for an entrance hall of the present disclosure may be configured such that air is introduced into the footrest. Accordingly, air may be discharged evenly to the entire portion of the footrest, and thus an air shower may be performed regardless of a person's position. That is, air may be prevented from being concentrated on any one portion (for example, an air introduction side) of the footrest.

In addition, in the hygiene management device for an entrance hall of the present disclosure, the air outlet of the inflow path may be formed in a rear edge in the function module. Accordingly, even if dust or water falls down to the bottom of the inside of the function module, the dust or water may be prevented from blocking the inflow path or from flowing back to the inflow path and flowing down to the fan assembly.

In addition, in the hygiene management device for an entrance hall of the present disclosure, the opening/closing unit may include shutters. Accordingly, air supply for the air shower may be selectively stopped depending on a situation.

In addition, in the hygiene management device for an entrance hall of the present disclosure, the opening/closing unit may include the first shutter and a second shutter. Accordingly, air may be selectively supplied toward at least one of the function module and the duct unit according to a user's needs or circumstances.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
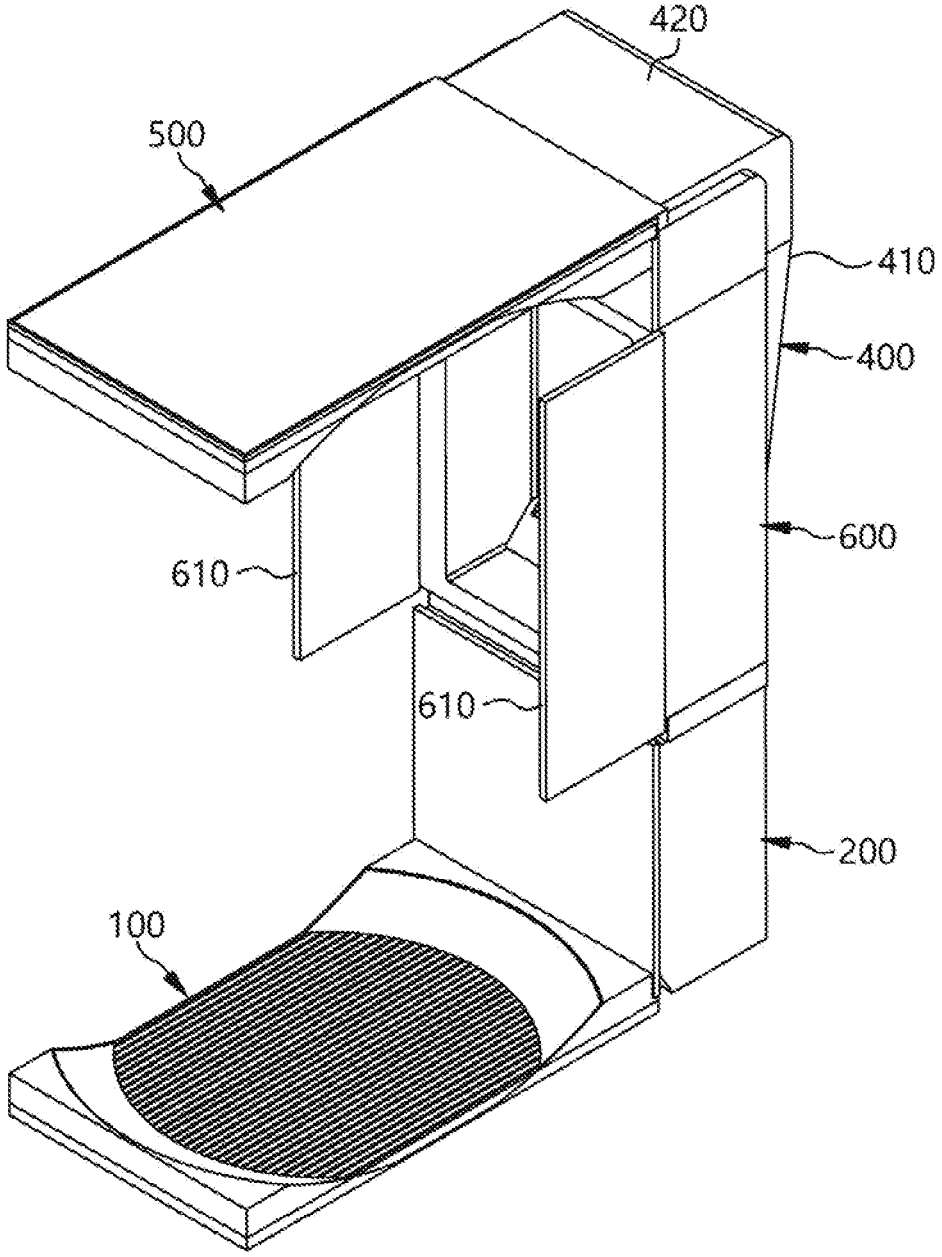
FIG. 1 is a top perspective view of a hygiene management device for an entrance hall according to an embodiment of the present invention.

The present invention will now be described with reference to the accompanying drawings, wherein the same reference numerals have been used to identify the same or similar elements throughout the several views.

Hereinafter, the exemplary embodiment of the hygiene management device for an entrance hall of the present disclosure will be described with reference to FIGS. 1 to 30.

Prior to description, the hygiene management device for an entrance hall according to the embodiment of the present disclosure may be installed in an entrance space through which a person goes in and out of an indoor space.

For example, when the hygiene management device for an entrance hall is installed in a residential space, the hygiene management device for an entrance hall may be installed in a vestibule. That is, the vestibule may be the entrance space.

When the hygiene management device for an entrance hall is installed in an office space, the hygiene management device for an entrance hall may be installed in space provided in the entrance hall of the office space.

FIGS. 1 to 5 are views illustrating the hygiene management device for an entrance hall according to the embodiment of the present disclosure when viewed in each direction.

Figure 2:
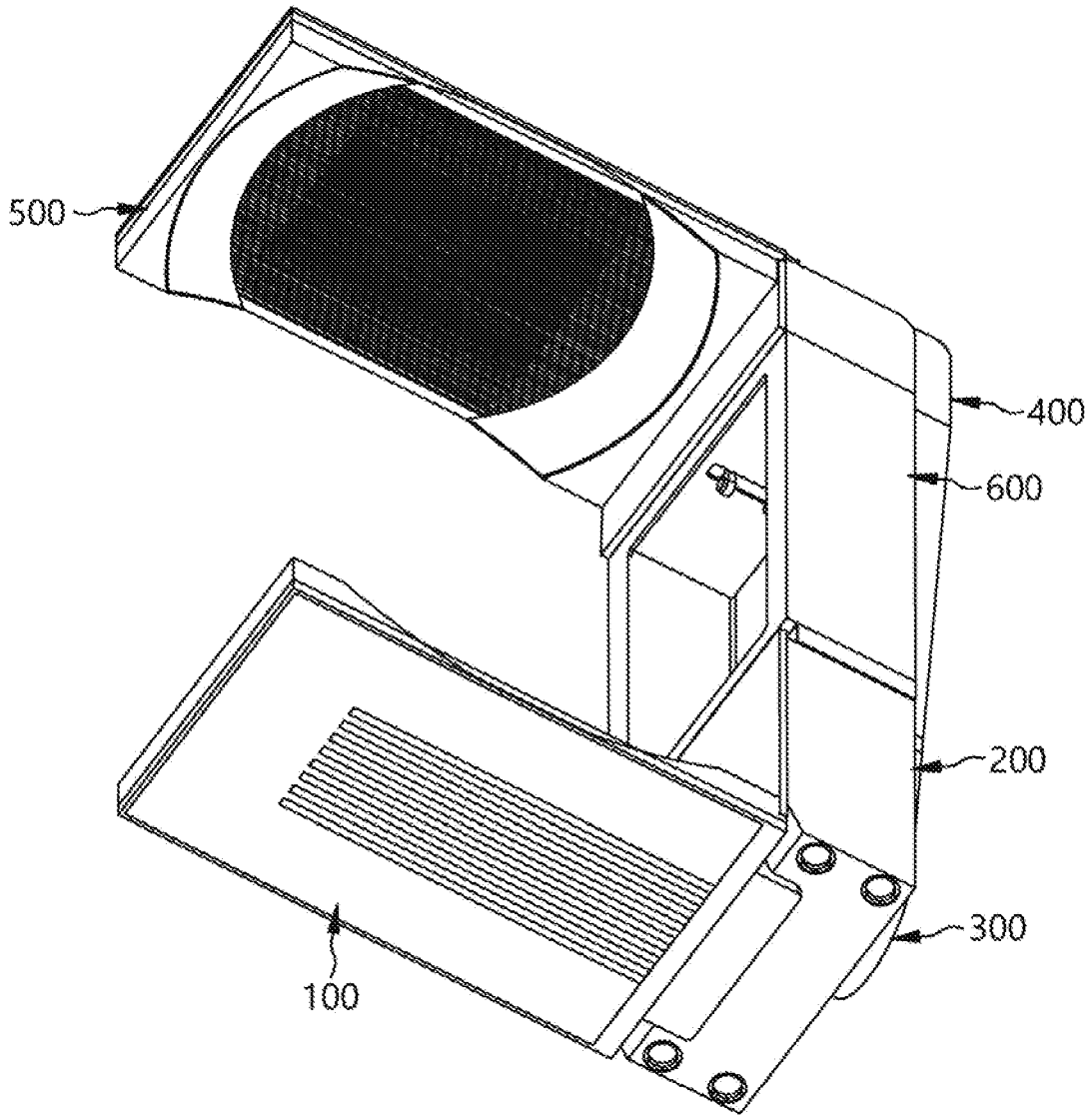
FIG. 2 is a bottom perspective view of the hygiene management device for an entrance hall according to an embodiment of the present invention.
Figure 3:
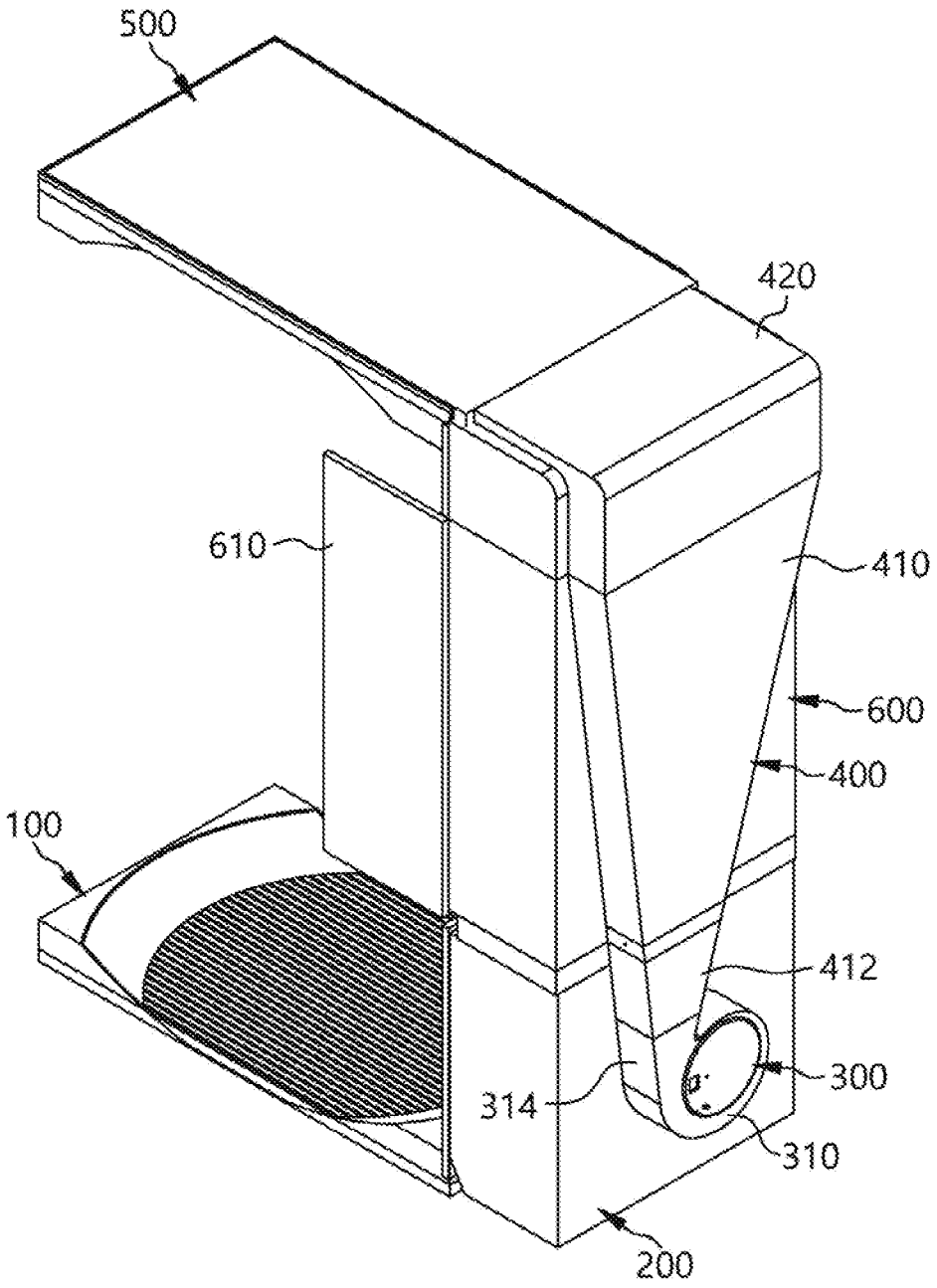
FIG. 3 is a rear perspective view of the hygiene management device for an entrance hall according to an embodiment of the present invention.
Figure 4:
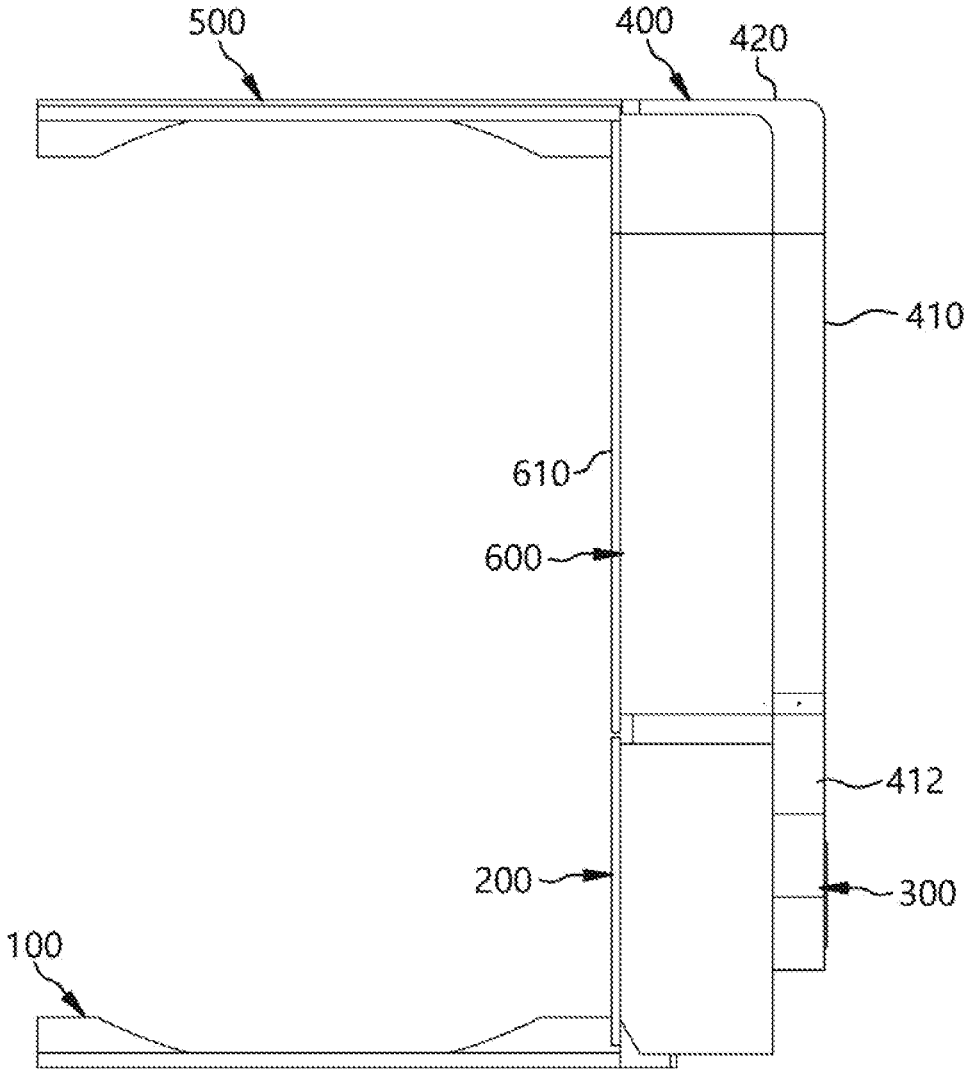
FIG. 4 is a side view of the hygiene management device for an entrance hall according to an embodiment of the present invention.
Figure 5:
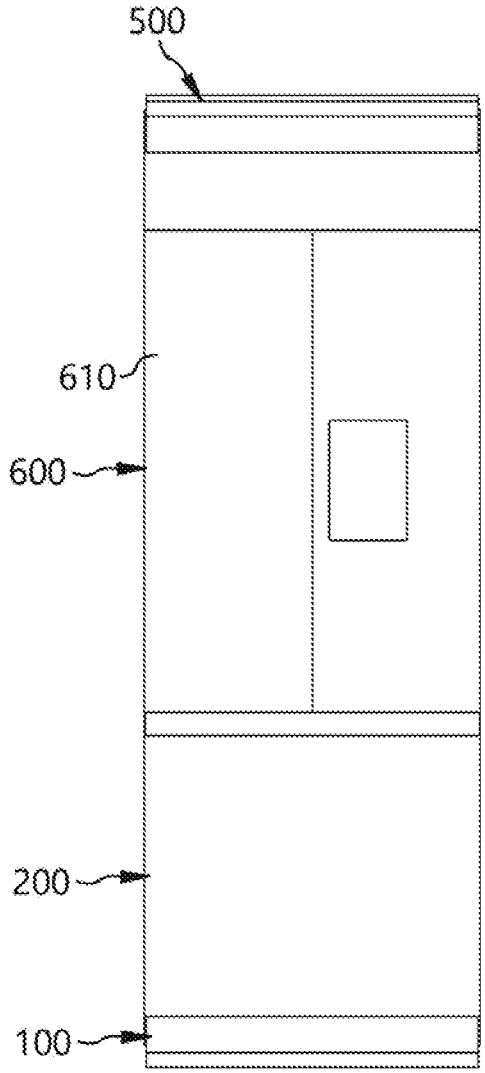
FIG. 5 is a front view of the hygiene management device for an entrance hall according to an embodiment of the present invention.

That is, FIG. 1 is a top perspective view, FIG. 2 is a bottom perspective view, FIG. 3 is a rear perspective view, FIG. 4 is a side view, and FIG. 5 is a front view.

Figure 6:
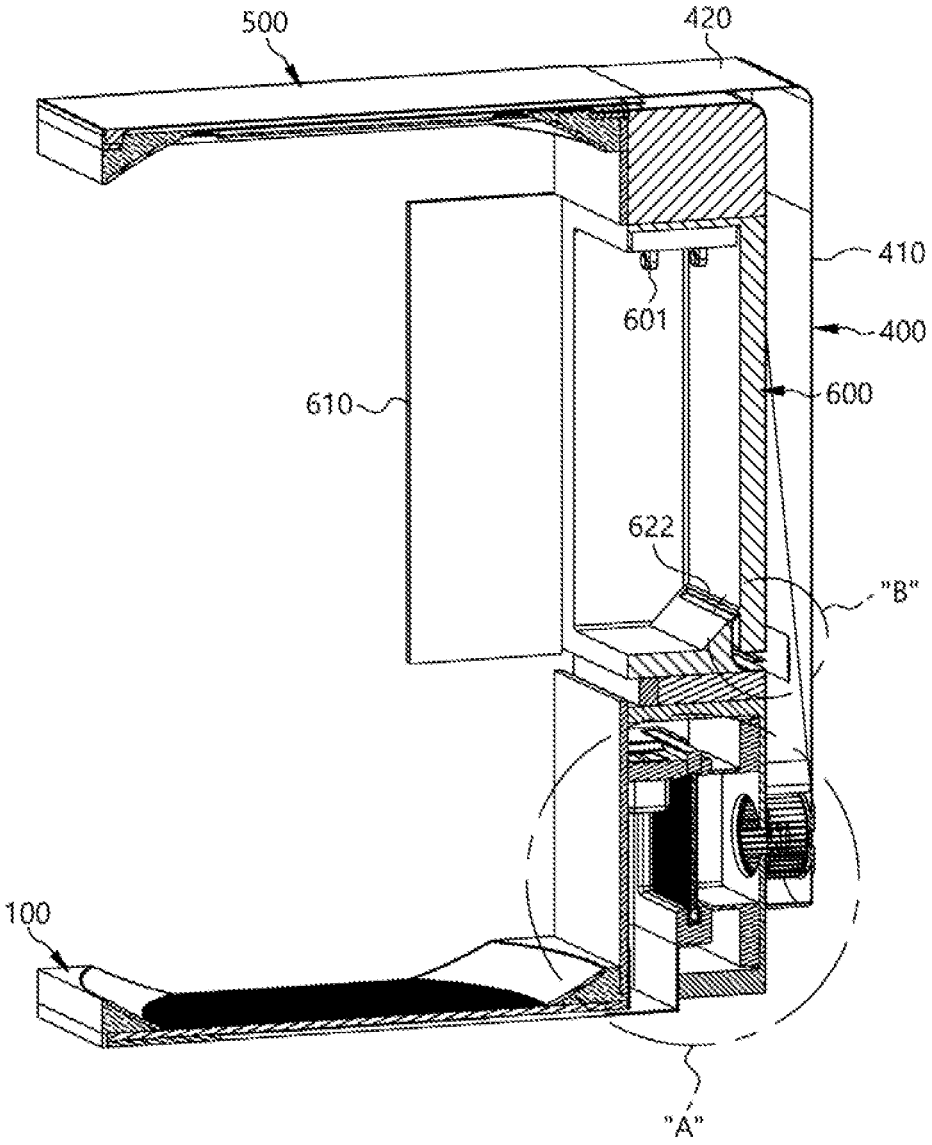
FIG. 6 is a cut-away perspective view illustrating the internal structure of the hygiene management device for an entrance hall according to an embodiment of the present invention.
Figure 7:
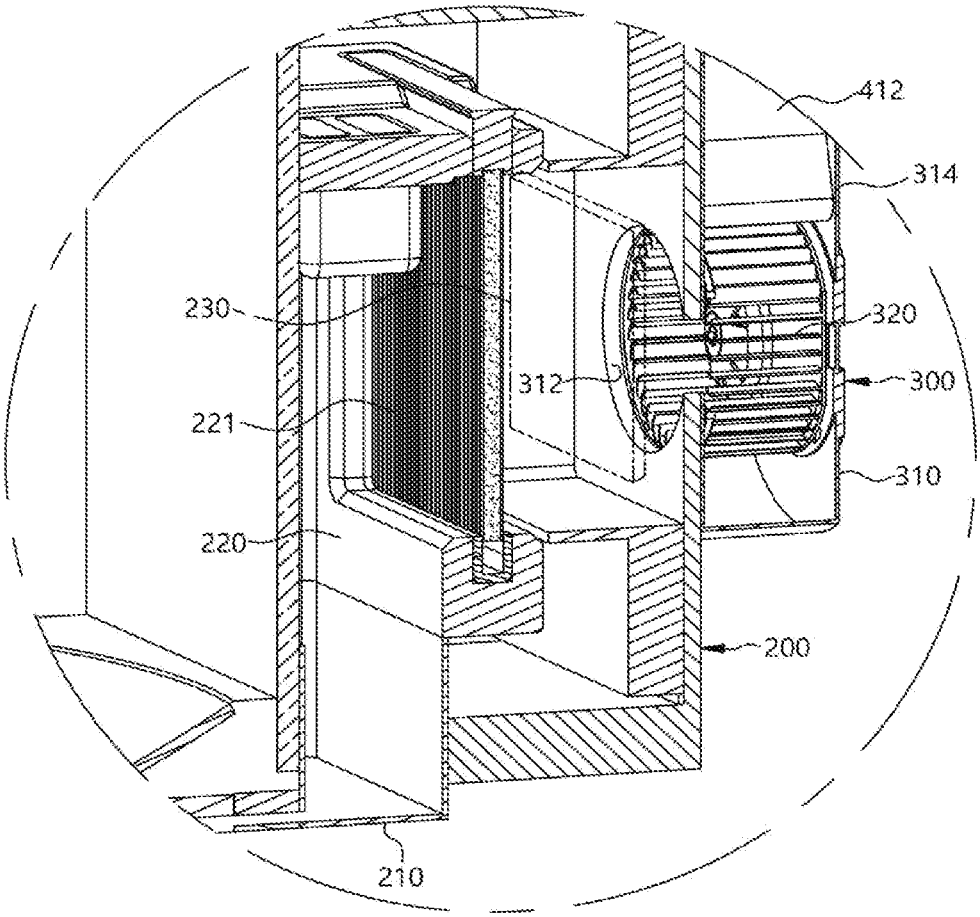
FIG. 7 is an enlarged view of an "A" part of FIG. 6.

In addition, FIG. 6 is a cut-away perspective view illustrating the internal structure of the hygiene management device for an entrance hall.

As illustrated in these drawings, the hygiene management device for an entrance hall according to the embodiment of the present disclosure may include a fan assembly 300 configured to generate an air blowing force, a function module 600 providing a storage space, and an air discharger 500 configured to discharge air to a person. Particularly, air blown by the fan assembly 300 may be supplied only to one of the function module 600 and the air discharger 500 or simultaneously to both of the function module 600 and the air discharger 500.

Hereinafter, each of the components of the hygiene management device for an entrance hall according to the embodiment of the present disclosure having such characteristics will be described more in detail.

First, the hygiene management device for an entrance hall according to the embodiment of the present disclosure may include the fan assembly 300.

The fan assembly 300 is a device which generates an air blowing force (i.e., an air flow).

Such a fan assembly 300 may be located at one side wall inside the entrance space, and may be preferably located at the lower part of the side wall of the entrance space.

The fan assembly 300 may include a fan housing 310 and a blower fan 320.

Here, the fan housing 310 may constitute the exterior of the fan assembly 300, and the blower fan 320 may be installed in the fan housing 310.

The fan housing 310 may include an introduction hole 312 through which air is introduced into the fan housing 310, and an outlet pipe 314 through which air is discharged from the fan housing 310. In this case, the introduction hole 312 (see FIG. 7) may be formed in the front surface (i.e., a surface directed toward a person) of the fan housing 310, and the outlet pipe 314 (see FIG. 3) may be formed on the circumferential surface (i.e., the upper surface) of the fan housing 310.

In addition, the blower fan 320 may be configured as a centrifugal fan which introduces air in an axial direction thereof and then discharges the air in a radial direction thereof. However, the blow fan 320 may be any type of fan. That is, the blower fan 320 may be configured to introduce air through the introduction hole 312 and then discharge the air to the outlet pipe 314. The blower fan 320 may be operated by a fan motor installed inside or outside of the fan housing 310.

Meanwhile, an air management module 200 may be located at the air introduction side of the fan assembly 300 (i.e., the side of the introduction hole 312) which is the front surface of the fan assembly 300.

The air management module 200 may be provided to remove foreign matter (e.g., dust, moisture, and bacteria, etc.) contained in air flowing to a duct unit 400.

The air management module 200 may include an introduction duct 210. The introduction duct 210 may be configured to be open to the inside of the entrance space (e.g., the space defined by the hygiene management device). In this case, an air inlet of the introduction duct 210 may be located on a bottom of the entrance space, and an air outlet of the introduction duct 210 thereof may be located in the air management module 200.

In addition, the air management module 200 may include a filter housing 220. At least one filter 221 may be provided in the filter housing 220. That is, air introduced through the introduction duct 210 into the air management module 200 may flow through one or more filters 221 in the filter housing 220 and then may be supplied to the fan housing 310 of the fan assembly 300. In this case, the filter 221 may include at least one filter, and may be configured as a filter that removes at least one of dust, odor components, moisture, and bacteria.

The filter housing 220 may be installed to be removed into the entrance space from the air management module 200. For example, the filter housing 220 may be mounted rotatably to the air management module 200. In this case, the upper surface of the filter housing 220 may be open to the inside of the entrance space, and accordingly, a user may easily replace or clean the filter 221 as required.

Meanwhile, the air management module 200 may include a temperature control part 230 (see FIGS. 7 and 9) between the air outlet side of the filter housing 220 and the fan housing 310. That is, the temperature and humidity of air passing through the temperature control part 230 may be controlled.

Such a temperature control part 230 may be provided as a component capable of controlling temperature or heat, such as a sheath heater, a heat transfer pipe heater, or a heat exchanger which is heated by electricity.

Next, the hygiene management device for an entrance hall according to the embodiment of the present disclosure may include the duct unit 400.

The duct unit 400 may function to guide an air flow generated by the fan assembly 300. The duct unit 400 may be configured to guide the air flow to the upper portion of the entrance space.

The duct unit 400 may include a first duct 410 and a second duct 420.

Here, the first duct 410 may be configured to extend along the wall surface of a side of the entrance space at which the fan assembly 300 is located. That is, the first duct 410 may extend vertically towards a top side of the hygiene management device and may be fluidly connected to the second duct 420.

A first inlet 412 of the first duct 410 may be connected to the outlet pipe 314 of the fan housing 310. The outlet pipe 314 of the fan housing 310 may be configured to be open upwards, and the first inlet 412 of the first duct 410 may be formed at the lower end of the first duct 410 to be connected to the outlet pipe 314.

The connection portion of the first inlet 412 of the first duct 410 with the outlet pipe 314 may be narrower than other portions of the first duct 410, or the first duct 410 may be configured to become narrower gradually toward the connection portion of the first inlet 412 of the first duct 410 with the outlet pipe 314. That is, the first inlet 412 and the first duct 410 become progressively larger (e.g., wider) from the fan assembly 300 to the second duct 420.

In addition, the second duct 420 may be located at the ceiling of the entrance space (i.e., may define a top of the hygiene management device) and may be configured to receive air flowing through the first duct 410 (i.e. may be fluidly connected to the first duct 410). To this end, an end of the second duct 420 may be connected to the first duct 410. Of course, the second duct 420 and the first duct 410 may be configured as an integral structure.

Next, the hygiene management device for an entrance hall according to the embodiment of the present disclosure may include the air discharger 500.

The air discharger 500 may be configured to receive air from the second duct 420 and to discharge the air toward a person.

The air discharger 500 may be located at the ceiling of the entrance space (i.e., may define a top surface of the hygiene management device) and may be connected to the second duct 420 of the duct unit 400. The air discharger 500 may be installed by being embedded in the ceiling of the entrance space.

The air discharger 500 may be connected to another flow path extending from the second duct 420, may be installed on any one surface of the upper and perimeter surfaces of the second duct 420, or may be installed on at least two surfaces of the second duct 420 in cooperation therewith. Of course, the bottom surface of the second duct 420 may be configured to constitute the air discharger 500.

The air discharger 500 may be configured as a flow path (e.g., a grille) having multiple discharge holes or slots formed therethrough. Of course, the air discharger 500 may be configured as a discharge nozzle or as a pipe having multiple discharge holes formed therein.

Next, the hygiene management device for an entrance hall according to the embodiment of the present disclosure may include the function module 600.

The function module 600 may be a part which provides the storage space in which clothes or any other type of items are stored in the entrance space.

There may be a clothing management device as an example of the function module 600. When clothes are placed inside the clothing management device, the clothing management device can remove dust on the clothes or sterilize the clothes. Alternatively, the clothing management device may function to unwrinkle clothing, such as by steaming. Further, any type of item may be inserted into the function module 350, such as shoes, glasses, an umbrella or the like.

As other examples of the function module 600, there may be various devices such as a shoe management device, an umbrella management device, a shoe storage device, and an umbrella storage device, and the function module 600 may be provided as space in which a user's belongings are stored. For reference, each of these function modules 600 may not be configured as an independent function module, but some of the function modules may be combined with each other.

In addition, the function module 600 may be located at the upper side of the air management module 200 (e.g., above the air management module 200). That is, the fan assembly 300 may be located at a side and lower than the function module 600 (e.g., the fan module 300 may be disposed between the function module 600 and the air management module 200).

The rear surface of the function module 600 may be located to face the side wall of the entrance space, and the front surface of the function module 600 may be configured to be open toward a person located inside of the entrance space. In this case, the open front surface of the function module 600 may be configured to be opened and closed by a door 610. The door 610 may be a swinging door. Of course, the door 610 may be a sliding door or any type of door.

In addition, the first duct 410 of the duct unit 400 may be located at the rear surface of the function module 600, wherein the lower end of the first duct 410 may be connected to the fan assembly 300 and the upper end of the first duct 410 may be configured to extend up to a side higher than the function module 600 and to be connected to the second duct 420.

The front surface of the first duct 410 and the rear surface of the function module 600 may be configured as a single body or may be configured separately to be in close contact with each other (e.g., directly adjacent one another).

Figure 8:
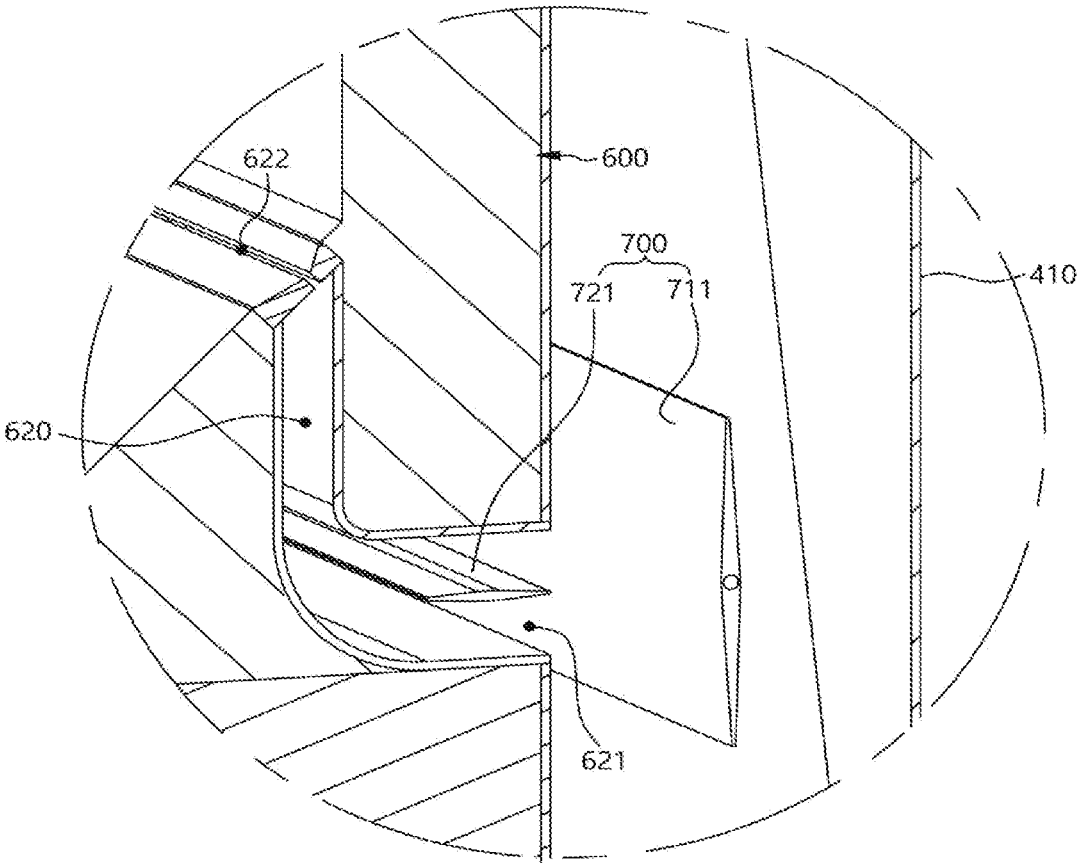
FIG. 8 is an enlarged view of a "B" part of FIG. 6.

In addition, an inflow path 620 communicating with the inside of the first duct 410 may be formed on the rear surface of the function module 600, as shown in FIG. 8.

An air inlet 621 of the inflow path 620 may be formed through the rear surface of the function module 600 to be open to the inside of the first duct 410. In addition, the air outlet 622 of the inflow path 620 may be configured to be open to the inside of the function module 600. That is, the internal storage space of the function module 600 and the internal space of the first duct 410 may communicate with each other due to the inflow path 620.

The air outlet 622 of the inflow path 620 may be formed in the bottom surface of the inside of the function module 600. That is, air may be discharged from the lowest space of the inside of the function module 600 toward the upper space thereof such that sufficient air can be supplied to the entire portion of the inside of the storage space.

However, according to items stored in the function module 600, water may be collected on the bottom of the inside of the function module 600 or dust may be accumulated thereon. Accordingly, when the air outlet 622 of the inflow path 620 is located at the lowest bottom surface of the inside of the function module 600, water or dust may fall down to the fan assembly 300.

Figure 9:
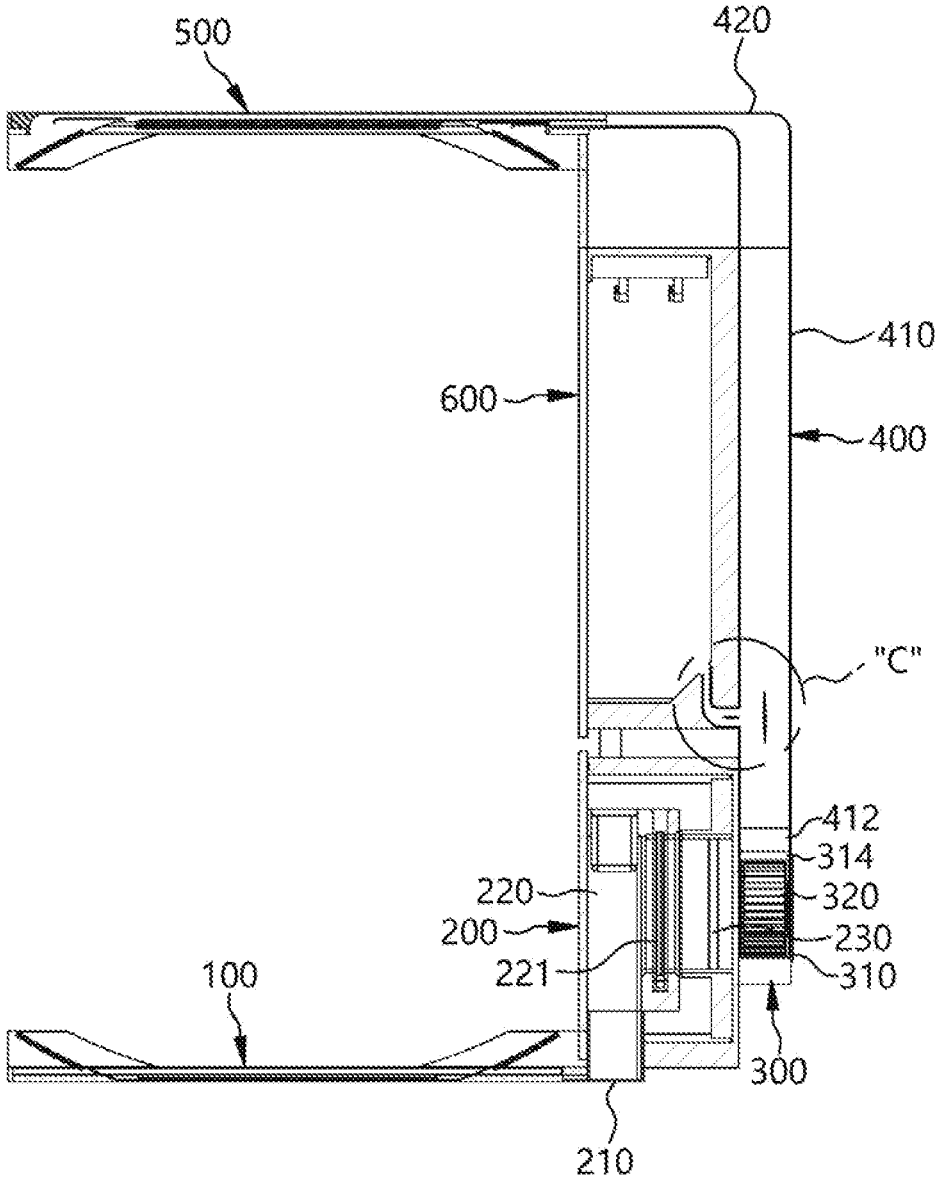
FIG. 9 is a sectional view of the hygiene management device for an entrance hall according to an embodiment of the present invention.

In consideration of this, as illustrated in FIGS. 6 and 9, the rear edge of the inside of the function module 600 may be configured to be inclined such that the rear edge is located at a position higher than the bottom surface of the inside of the function module 600, and the air outlet 622 is preferably formed in the rear edge. That is, the air outlet 622 may be formed in the rear edge located at a position higher than a bottom surface of the inside of the function module 600, so water or dust may be prevented from leaking (e.g., into the fan assembly 300 via the inflow path 620, through the air inlet 621) or the inflow path 620 may be prevented from being blocked by dust.

Next, the hygiene management device for an entrance hall according to the embodiment of the present disclosure may include an opening/closing unit 700.

The opening/closing unit 700 may function to allow an air flow generated by the fan assembly 300 to selectively move (e.g., flow to) to the function module 600 and/or the duct unit 400. That is, according to the operation of the opening/closing unit 700, air flowing through the first duct 410 from the fan assembly 300 may be supplied to only the function module 600 or may be supplied to both the function module 600 and the second duct 420.

For example, when performing an air shower on a person (e.g., blowing air onto the person), the opening/closing unit 700 may operate to enable air to flow to the second duct 420 from the first duct 410, and thus through the air discharger 500.

When a person's air shower stops or there is no person, the opening/closing unit 700 may operate to stop an air flow to the second duct 420 from the first duct 410. Accordingly, air may be supplied into only the function module 600, so unnecessary air discharge through the air discharger 500 may be prevented.

The opening/closing unit 700 may include a first shutter 711.

Here, the first shutter 711 may be located in the first duct 410 and may be configured to open and close the flow path of the inside of the first duct 410. The first shutter 711 may be operated by the driving force of a motor, wherein the motor may be located outside of the first duct 410 and may be installed to rotate the first shutter 711.

Particularly, the first shutter 711 may be configured to close or open any one portion of the first duct 410 by rotating. For example, the left-to-right and front-to-rear widths of the first shutter 711 may be the same as or larger than the left-to-right and front-to-rear widths of the inside of the first duct 410, and the thickness of the first shutter 711 may be configured to be thinner than the left-to-right width or the front-to-rear width thereof. That is, the first shutter 711 may be sized so as to at least encompass an entire cross-section of the first duct 410, in the closed position of the first shutter 711, to block the flow of air through the first duct 410. However, the first shutter 711 may have a cross-section larger than that of the first duct 410, such that when the first shutter 711 is inclined relative to the first duct 410, the first shutter 711 may block air flow through the first duct 410.

In the first duct 410, the first shutter 711 may be installed at a communication portion of the first duct 410 with the inflow path 620 (e.g., the air inlet 621). Specifically, the first shutter 711 may be located at a position higher than the communication portion of the first duct 410 with the inflow path 620 or may be located at a same height of the communication portion of the first duct 410 with the inflow path 620.

Particularly, the first shutter 711 may operate to open both the first duct 410 and the communication portion of the first duct 410 with the inflow path 620 or to open only the inflow path 620.

That is, the first shutter 711 may close the first duct 410 to control an air flow generated by the fan assembly 300 such that the air flow is supplied into only the function module 600. In this case, in the state in which the first shutter 711 operates to close the first duct 410, the first shutter 711 may be disposed to be inclined to guide the air flow toward the inflow path 620.

In addition, the first shutter 711 may open only a portion of the first duct 410 and may control an air flow generated by the fan assembly 300 such that the air flow is divided to be supplied into the function module 600 and the second duct 420.

Additionally, the opening/closing unit 700 may include a second shutter 721. That is, regardless of whether the first duct 410 is opened, the second shutter 721 may selectively close the inflow path 620. The second shutter 721 may be disposed in the inflow path 620.

Of course, when the opening/closing unit 700 includes both the first shutter 711 and the second shutter 721, more various air flows may be realized.

Figure 10:
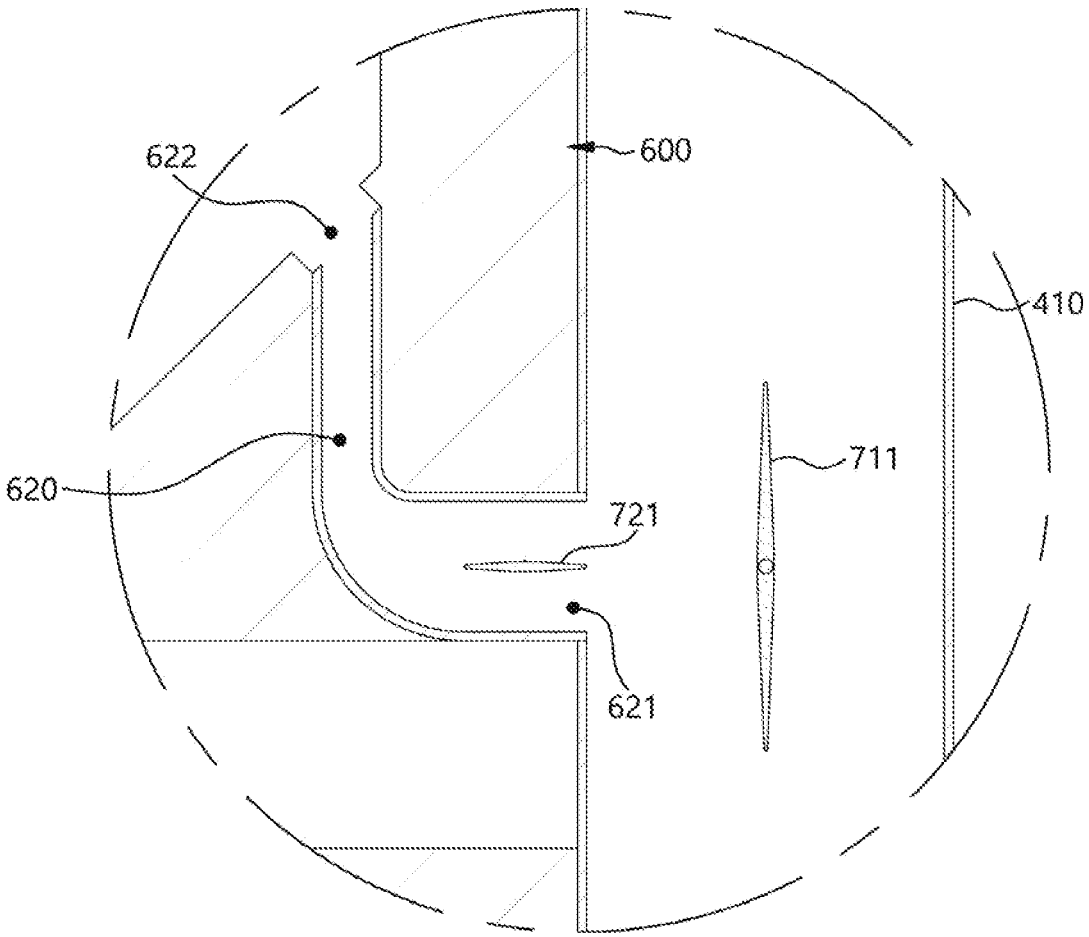
FIG. 10 is an enlarged view of a "C" part of FIG. 9.
Figure 11:
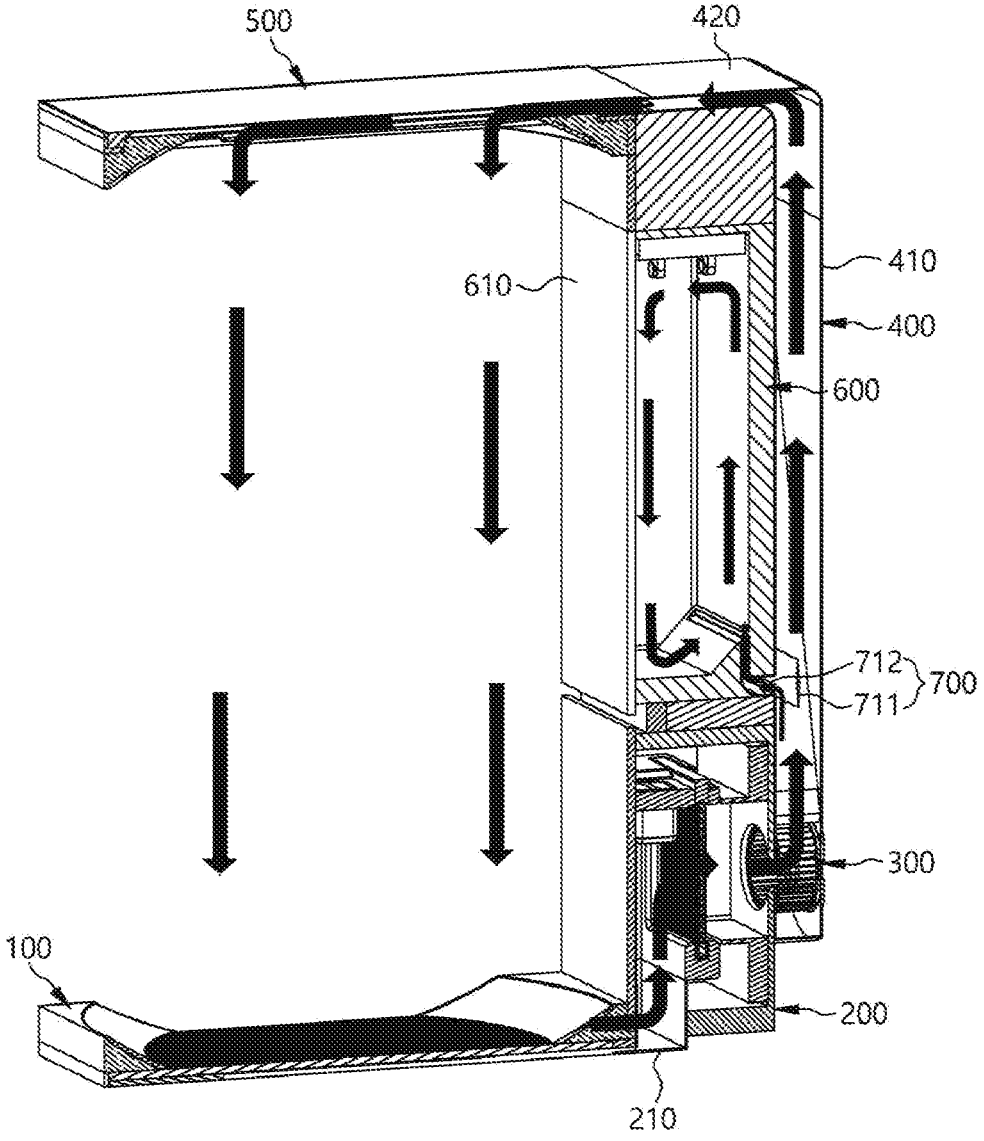
FIG. 11 is a cut-away perspective view illustrating an air flow at a time at which a first shutter and a second shutter of the hygiene management device for an entrance hall according to the embodiment of the present disclosure are opened.

For example, as illustrated in FIGS. 9 to 11, the first shutter 711 and the second shutter 721 may operate and open the second duct 420 and the inflow path 620, respectively, such that the second duct 420 and the inflow path 620 can receive air from the first duct 410. Accordingly, a person's air shower and air supply into the function module 600 may be performed simultaneously.

Figure 12:
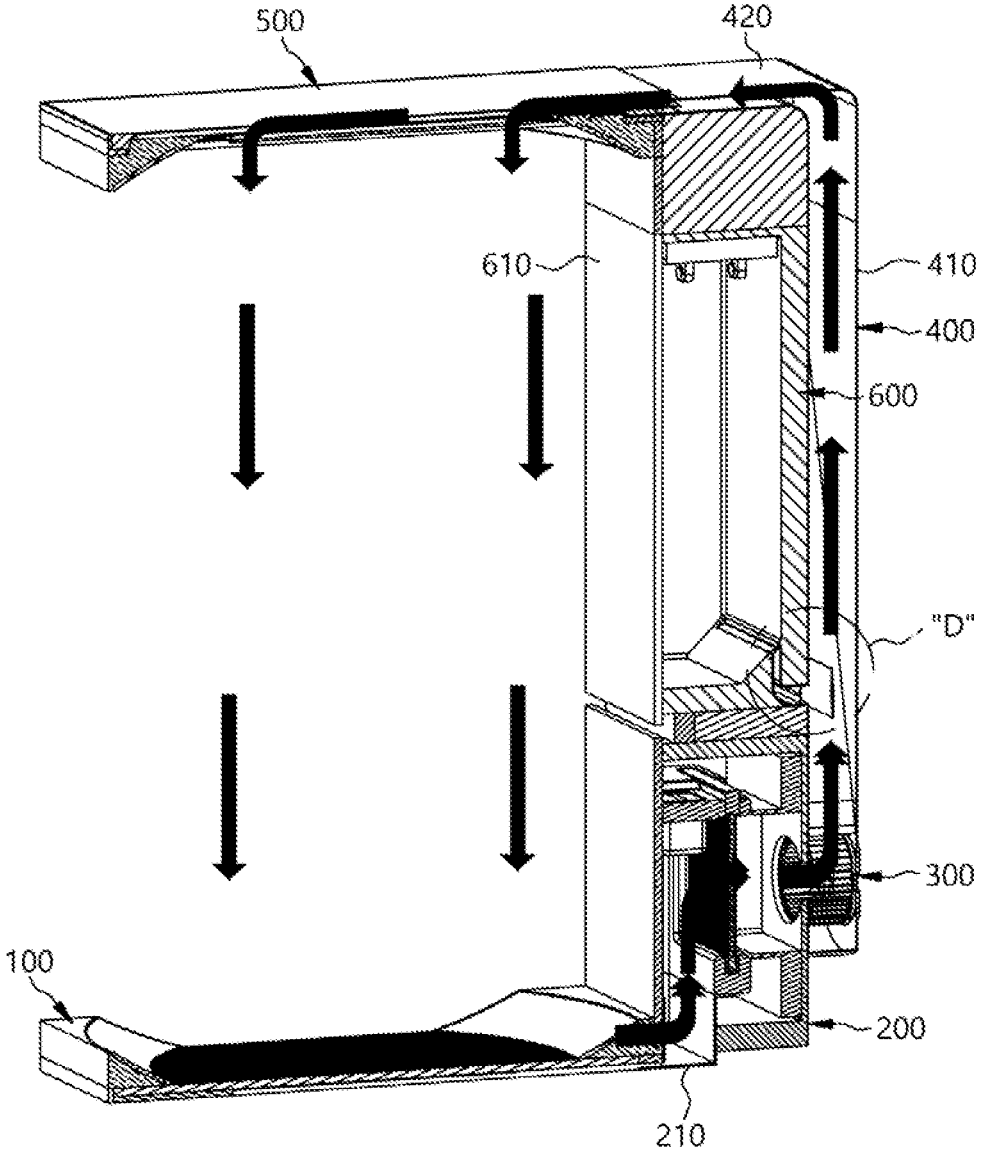
FIG. 12 is a cut-away perspective view illustrating an air flow at a time at which the second shutter of the hygiene management device for an entrance hall according to the embodiment of the present disclosure is closed.
Figure 13:
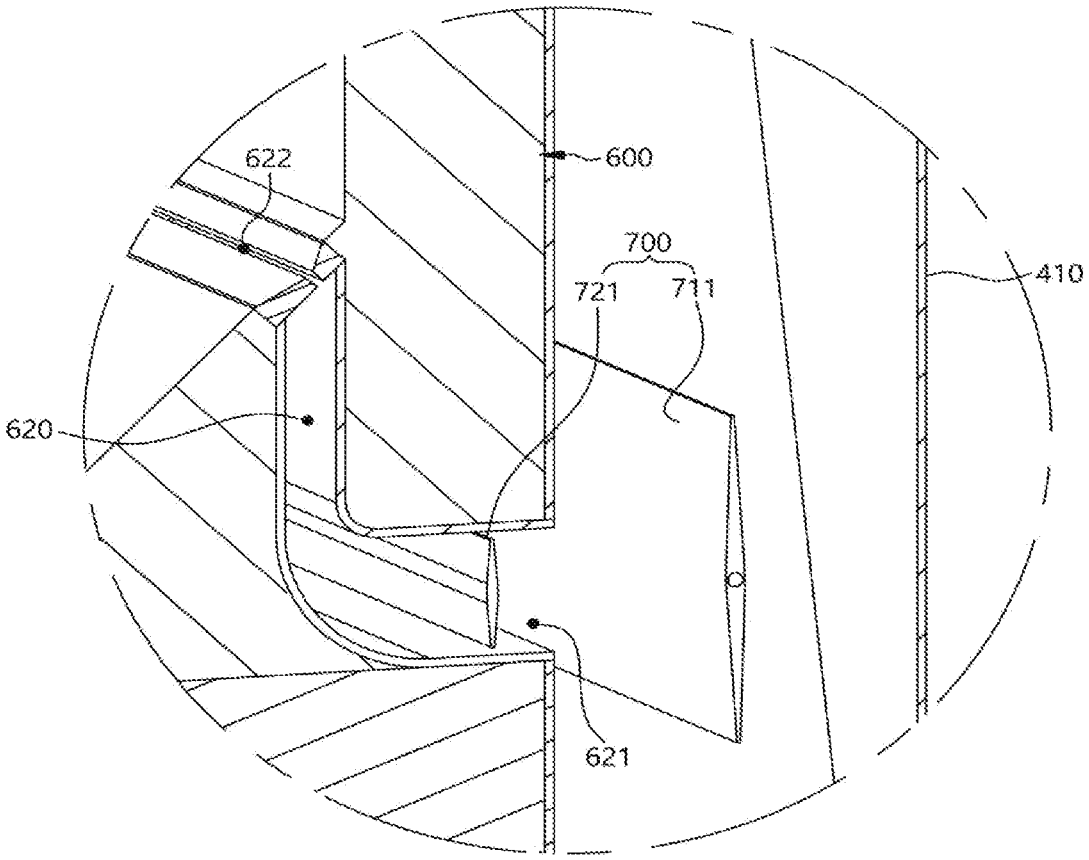
FIG. 13 is an enlarged view of a "D" part of FIG. 12.
Figure 14:
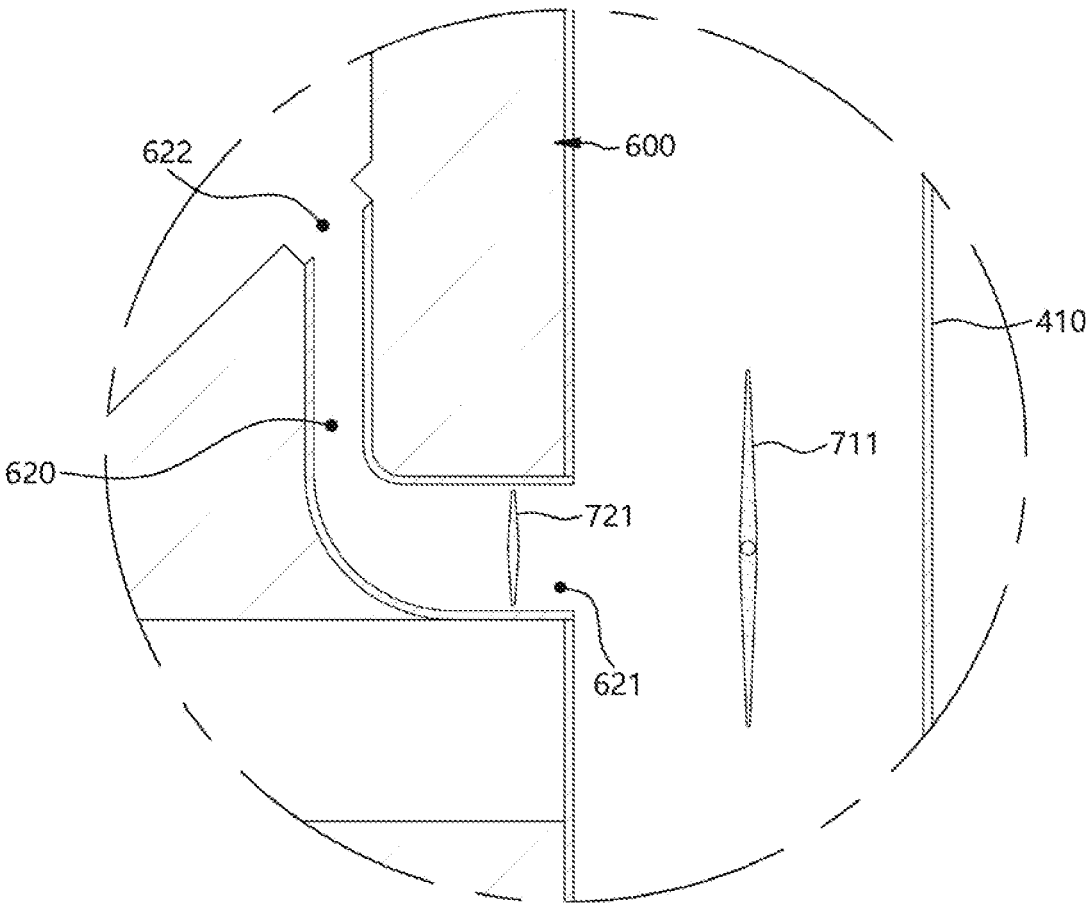
FIG. 14 is an enlarged view of a state in which the first shutter is opened and the second shutter is closed in the hygiene management device for an entrance hall according to an embodiment of the present invention.

In addition, as illustrated in FIGS. 12 to 14, the first shutter 711 and the second shutter 721 may operate and may open the second duct 420 such that the second duct 420 can receive air from the first duct 410, and may close the inflow path 620. Accordingly, an air discharge amount for an air shower may be increased. In this case, air may not be supplied into the function module 600.

Figure 15:
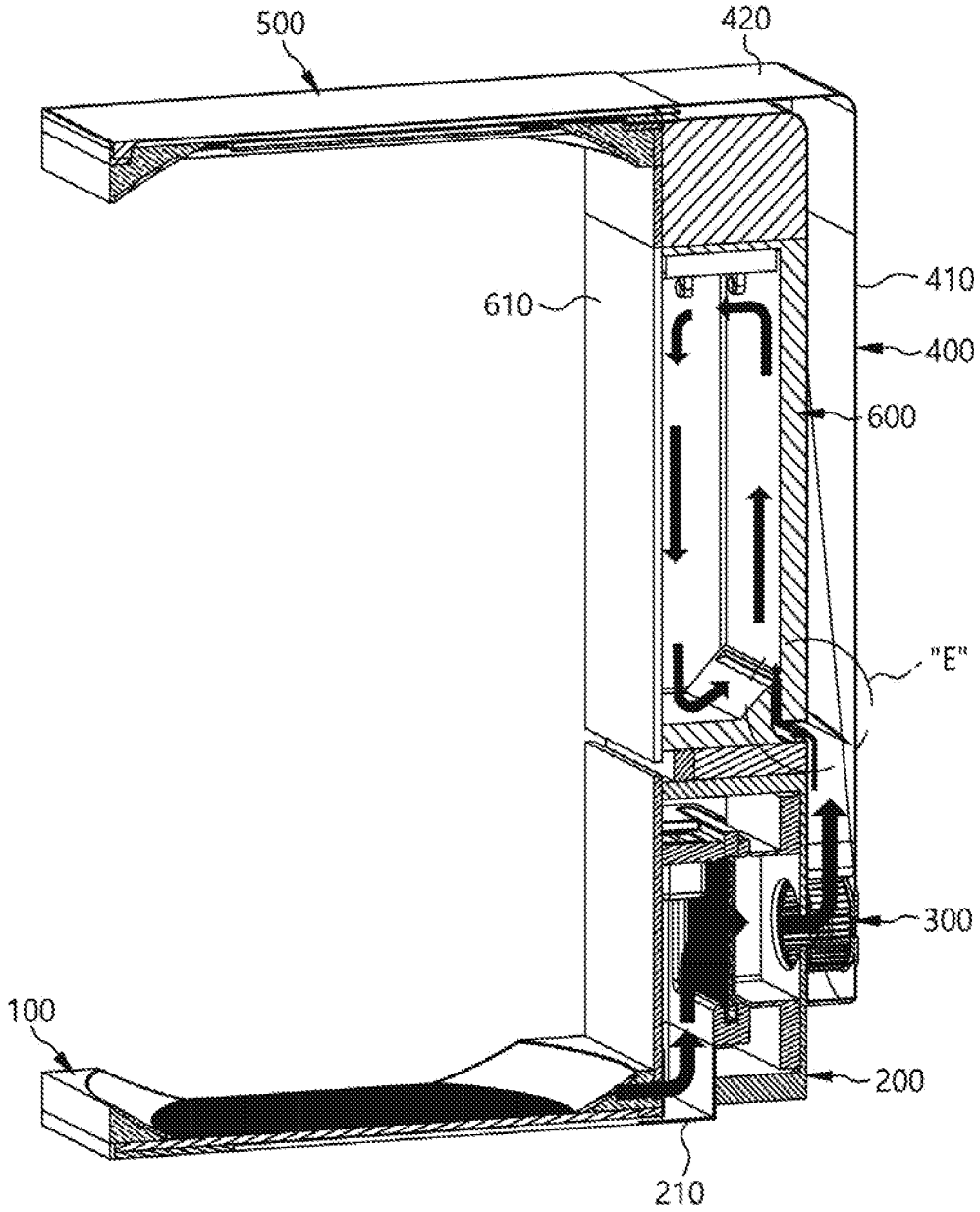
FIG. 15 is a cut-away perspective view illustrating an air flow at a time at which the first shutter of the hygiene management device for an entrance hall according to the embodiment of the present disclosure is closed.
Figure 16:
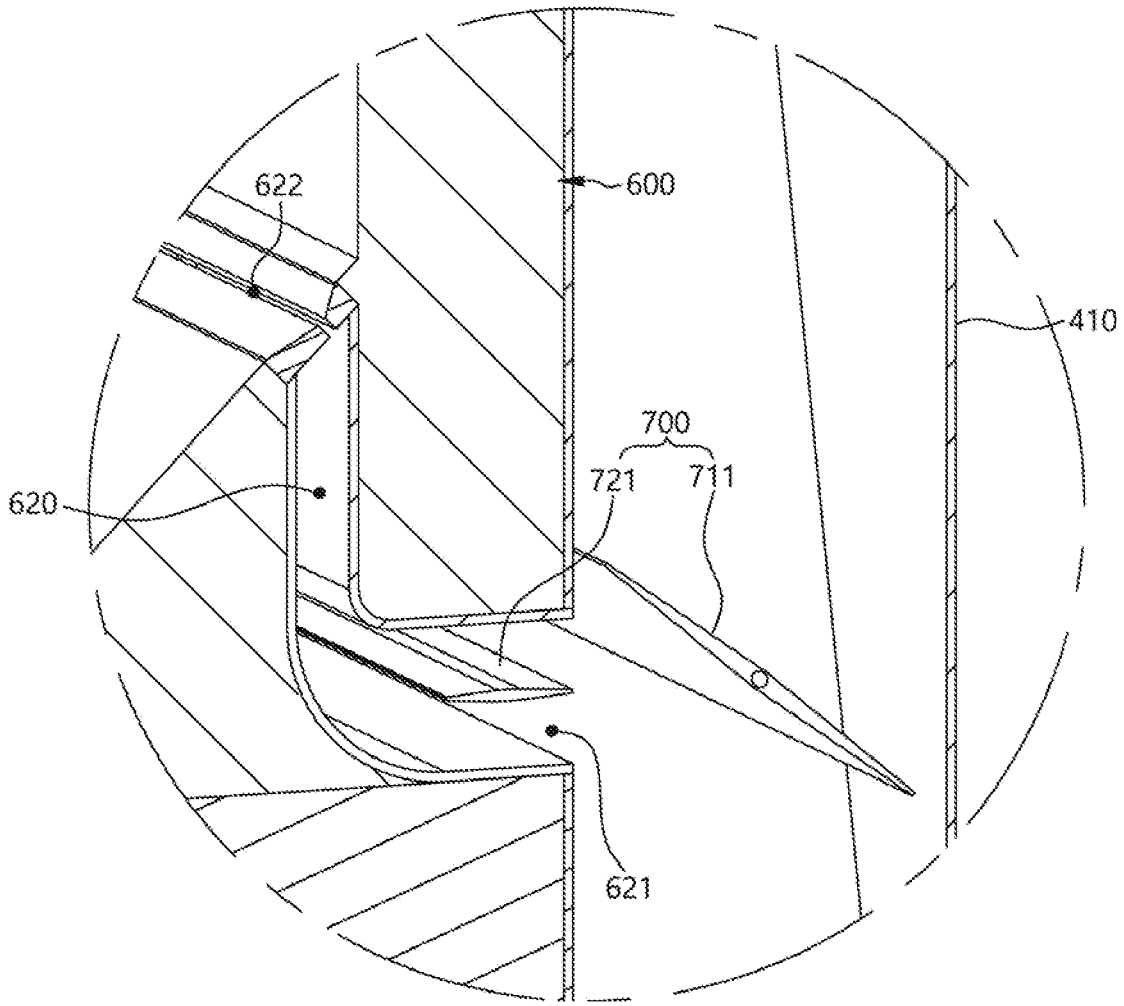
FIG. 16 is an enlarged view of an "E" part of FIG. 15.
Figure 17:
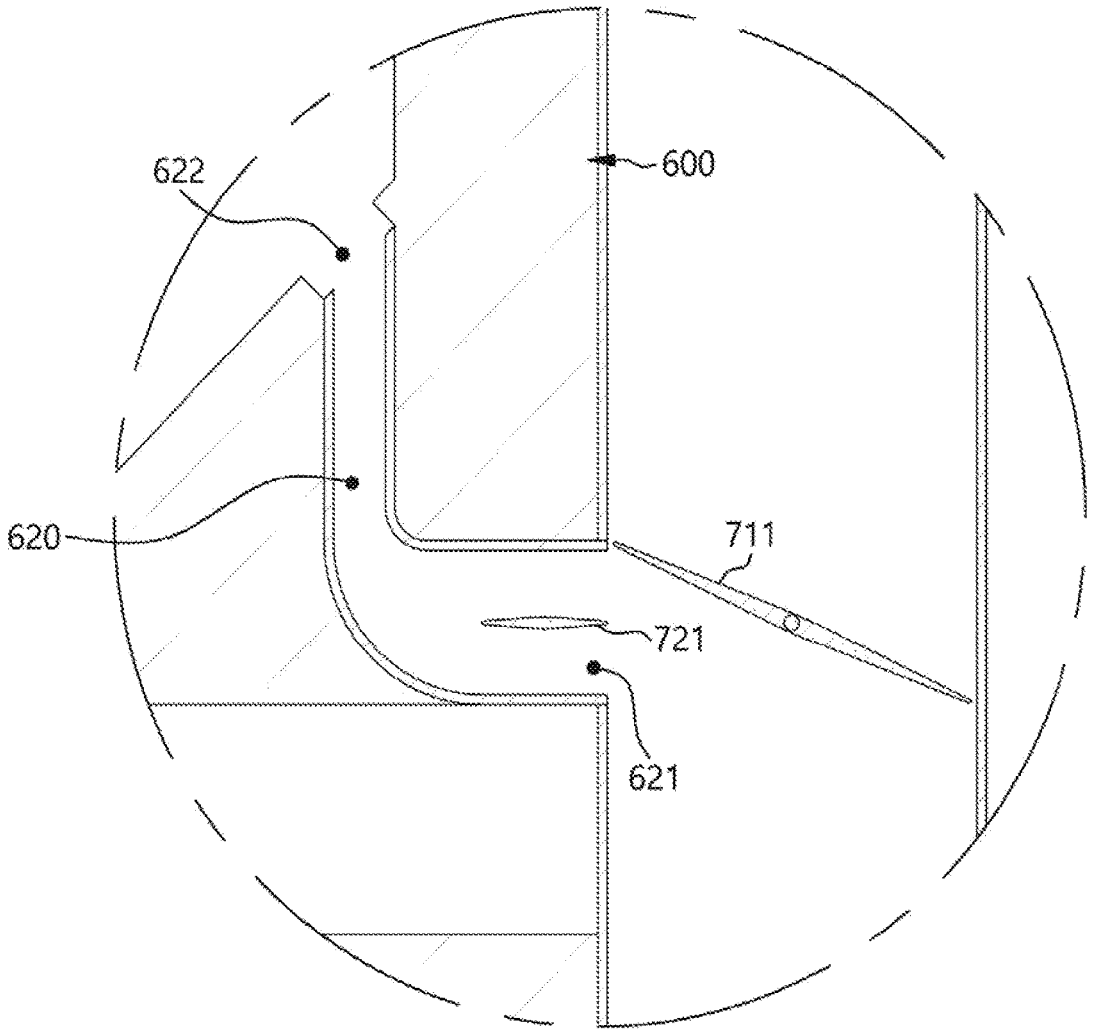
FIG. 17 is an enlarged view of a state in which the first shutter is closed and the second shutter is opened in the hygiene management device for an entrance hall according to an embodiment of the present invention.

Furthermore, as illustrated in FIGS. 15 to 17, the first shutter 711 and the second shutter 721 may operate and close the second duct 420 such that the second duct 420 cannot receive air from the first duct 410, and may open the inflow path 620. Accordingly, it is possible to supply air into only the function module 600 after the end of an air shower. That is, the first shutter 711 may be in a closed position while the second shutter 721 is in an open position to supply air through the inflow path 620 to the function module 600 (i.e., via air inlet 621 then air outlet 622).

Meanwhile, a footrest 100 may be provided on the bottom of the entrance space. The footrest 100 may be configured to have an area such that a person (or a plurality of people) can stand on the footrest 100.

In the illustrated drawing (e.g., FIGS. 1-6, 11, 12, 15, 18, 26 and 28-30), the footrest 100 may have a rectangular plate shape. However, according to the shape of the entrance space, the footrest 100 may be formed in various shapes, such as circular, oval, track-like, and polygonal shapes, etc. At least one person may be located on the footrest 100.

Particularly, the footrest 100 may be located directly under the air discharger 500 (e.g., the footrest 100 may face the air discharger 500) and may function to guide a person to a position on which the person is required to stand for air shower. The footrest 100 may be embedded in the bottom of the entrance space.

The footrest 100 may be connected to the air management module 200 (e.g., the footrest 100 may be fluidly connected to the air management module 200). That is, the footrest 100 and the air management module 200 may be configured to be combined with each other, so the footrest 100, the air management module 200, the fan assembly 300, the duct unit 400, the air discharger 500, and the function module 600 may be configured as a single device (or a structure), which can move to be installed (e.g., installed in various locations).

Hereinafter, the operation of the hygiene management device for an entrance hall according to the embodiment of the present disclosure described above will be described.

First, when a person enters an entrance space, the entering of a person may be detected by a sensor. The sensor may be a sensor which detects the opening of an entrance door (an outside door) or a motion sensor provided in the entrance space. Of course, the sensor may be configured as a piezoelectric sensor provided in the footrest 100. In this case, the piezoelectric sensor may detect that a person stands on the footrest 100.

When the entering of a person is detected and the person stands on the footrest 100, the blower fan 320 of the fan assembly 300 may operate. Of course, the blower fan 320 may be controlled to operate from the time at which the outside door is opened, or may be operated by the manual operation of a person.

In addition, when the blower fan 320 operates, the first shutter 711 may operate to allow an air flow in the duct unit 400. That is, the first shutter 711 may operate to open the inside of the first duct 410.

Furthermore, when the blower fan 320 operates, an air flow toward the duct unit 400 may be generated. Due to such an air flow, air in the entrance space may flow through the air management module 200 to the fan assembly 300. In this case, in the process in which the air flow through the air management module 200, the air may flow through the filter 221 provided in the filter housing 220, and in this process, foreign matter contained in the air may be removed.

Additionally, while the air flowing through the filter 221 flows through the temperature control part 230, the temperature of the air may be increased (or decreased) to a preset temperature, and moisture contained in the air may be removed.

In addition, the air passing through the temperature control part 230 may be introduced into the fan housing 310, and then may be supplied through the outlet pipe 314 to the first duct 410 by the guidance of the blower fan 320. Continuously, the air may flow sequentially through the first duct 410 and the second duct 420, and then may be discharged through the air discharger 500 to a person in the entrance space so as to perform air shower on the person.

The air used in the air shower may be introduced back into the footrest 100 located in the entrance space, and then may flow sequentially through the air management module 200, through the fan assembly 300, then through the duct unit 400, then through the air discharger 500. This air circulation may be repeated until the air shower stops.

When the second shutter 721 operates to close the inflow path 620, air may be discharged only toward a person as illustrated in FIG. 12. When the second shutter 721 operates to open the inflow path 620, air may be discharged to a person and may be supplied into the function module 600 as illustrated in FIG. 11.

Accordingly, dust, moisture, or contaminants introduced into the entrance space by being attached to a person's clothes, shoes, or body may be removed in the entrance space.

When the person moves outside the footrest 100 to enter an indoor space after air shower, air supply to the air discharger 500 may be controlled to stop. That is, when the person moves outside the footrest 100, the first shutter 711 located in the first duct 410 may operate to stop an air flow to the second duct 420 from the first duct 410. Of course, a person may manually manipulate the first shutter 711 to stop the air flow to the second duct 420.

Accordingly, the air flow to the second duct 420 may stop and thus air discharge through the air discharger 500 may stop.

In addition, air prevented from flowing to the second duct 420 due to the first shutter 711 may be supplied through the inflow path 620 into only the function module 600. Accordingly, the air may be supplied to an item (e.g., clothes, etc.) stored in the function module 600 to remove foreign matter remaining on the item. This is illustrated in FIG. 15.

Meanwhile, when a person enters the entrance space, or after air shower on the person is performed, items such as a coat, hat, and shoes worn by the person may be stored in the function module 600.

Accordingly, clothes stored in the function module 600 may be managed by air supplied into the function module 600 through the inflow path 620. That is, the air (e.g., dry air or hot air, which is dried and/or heated by the temperature control part 230) may be discharged to the clothes such that foreign matter remaining on the associated clothes is removed therefrom, or the clothes may be dried when the clothes is wet.

Particularly, the air may be continuously supplied into the function module 600 even after a person enters an indoor space so as to manage the clothes stored in the function module 600.

Accordingly, contaminants attached to a person's body may be removed in the entrance space, so the contaminants may be prevented from being introduced into an indoor space.

Particularly, a person's items, such as a coat, hat, gloves, or shoes, are stored in the function module 600 to be managed for a sufficient period of time, such that contaminants attached thereto are removed, so an indoor space may be prevented from being contaminated by the items.

When the blower fan 320 is stopped by a separate manipulation of a user (a person) or when a predetermined operation time of the blower fan 320 elapses, air supply into the function module 600 may stop.

After all, the hygiene management device for an entrance hall of the present disclosure may be configured such that air is circulated into the function module 600 for managing clothes or shoes, thereby performing the hygiene management of clothes such as a person's coat. Accordingly, contaminants may be fundamentally prevented from being introduced into an indoor space.

Furthermore, in the hygiene management device for an entrance hall of the present disclosure, air may be selectively supplied toward at least one of the function module 600 and the duct unit 400. Accordingly, according to various situations, air may be selectively supplied into the entrance space or the function module 600. For example, when there is no person in the entrance space, air may be supplied into only the function module 600.

Meanwhile, the hygiene management device of the present disclosure may be embodied in various forms according to the embodiment described above.

For example, the function module 600 according to another embodiment of the present disclosure may be configured to additionally perform the function of sterilizing clothes as well as the function of storing clothes. That is, when clothes are stored in the function module 600, the clothes may be sterilized in the function module 600.

Figure 18:
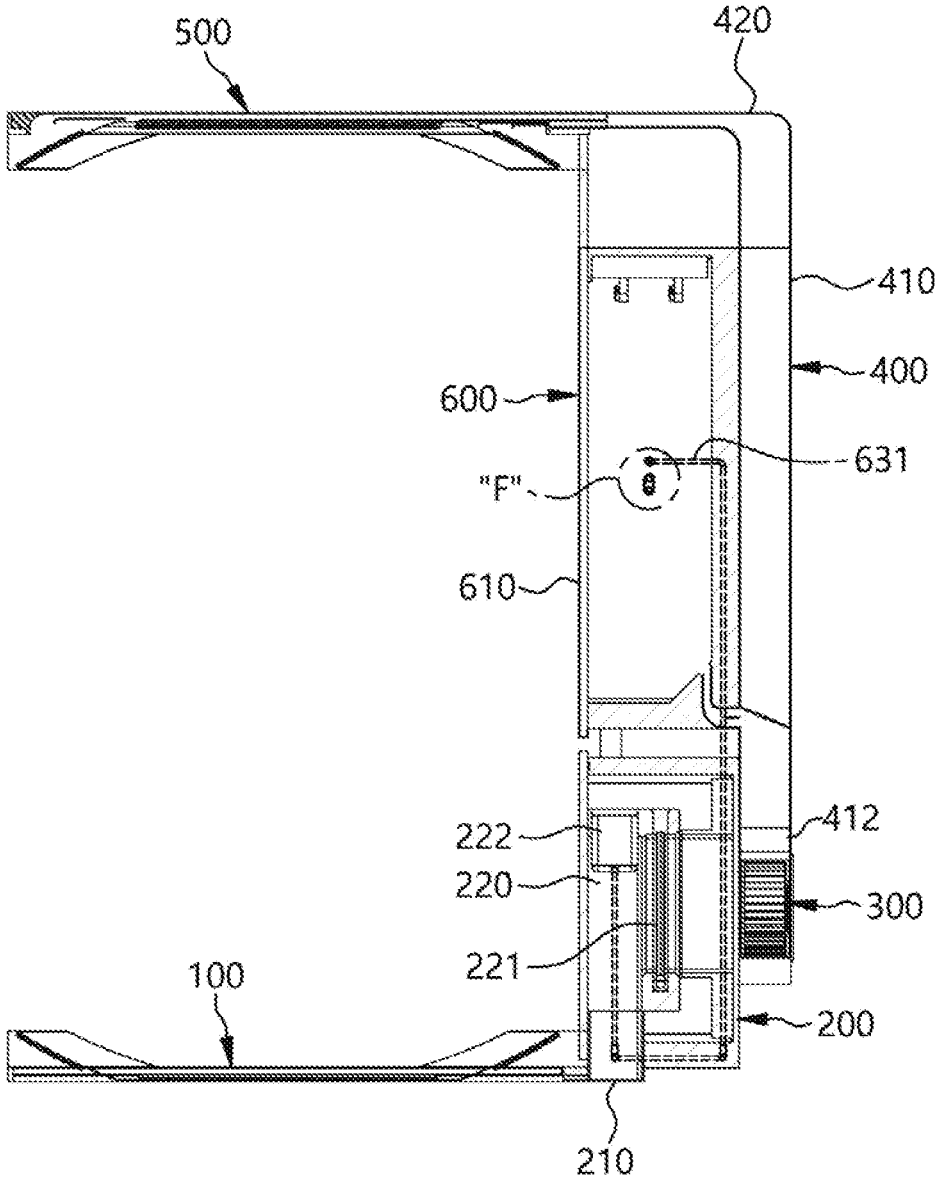
FIG. 18 is a sectional view of a state in which a disinfectant discharge nozzle is installed in the hygiene management device for an entrance hall according to an embodiment of the present invention.
Figure 19:
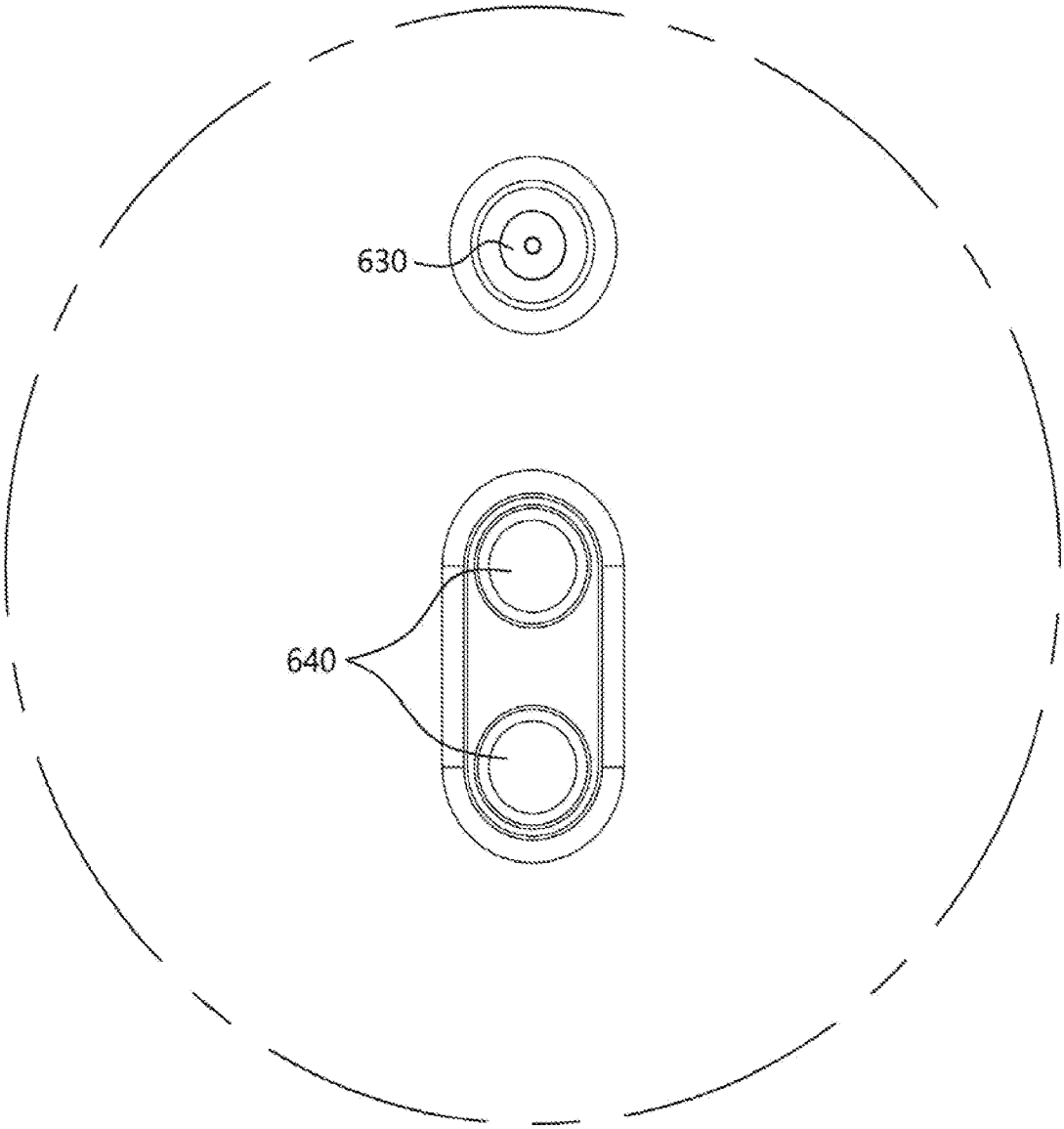
FIG. 19 is an enlarged view of an "F" part of FIG. 18.

To this end, as illustrated in FIGS. 18 and 19, the function module 600 may be provided with a disinfectant discharge nozzle 630. In this case, the disinfectant discharge nozzle 630 may discharge a disinfectant toward items (clothes) stored in the function module 600 so as to remove contaminants and bacteria on the items.

Such a disinfectant discharge nozzle 630 may be provided on at least one surface of the inner surfaces of the function module 600. For example, as illustrated in the embodiment, the disinfectant discharge nozzle 630 may be provided on any one side wall surface of the inside of the function module 600.

Particularly, the disinfectant discharge nozzle 630 may be configured such that a discharge angle (i.e., a discharge range) thereof is adjusted according to a distance between the disinfectant discharge nozzle 630 and clothes (items).

Figure 20:
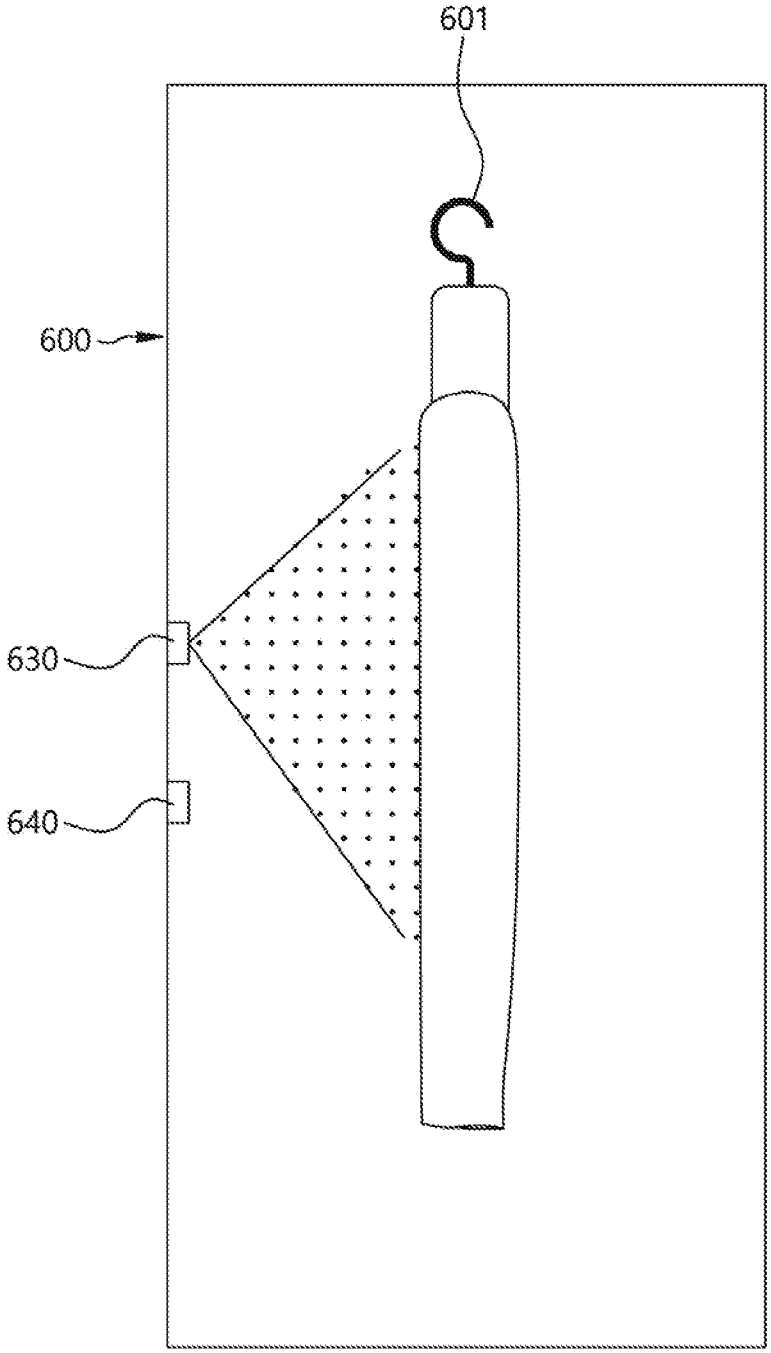
FIGS. 20 and 21 are views illustrating states in which a disinfectant is discharged when the discharge angle of the disinfectant discharge nozzle of the hygiene management device for an entrance hall according to an embodiment of the present invention is adjusted.
Figure 21:
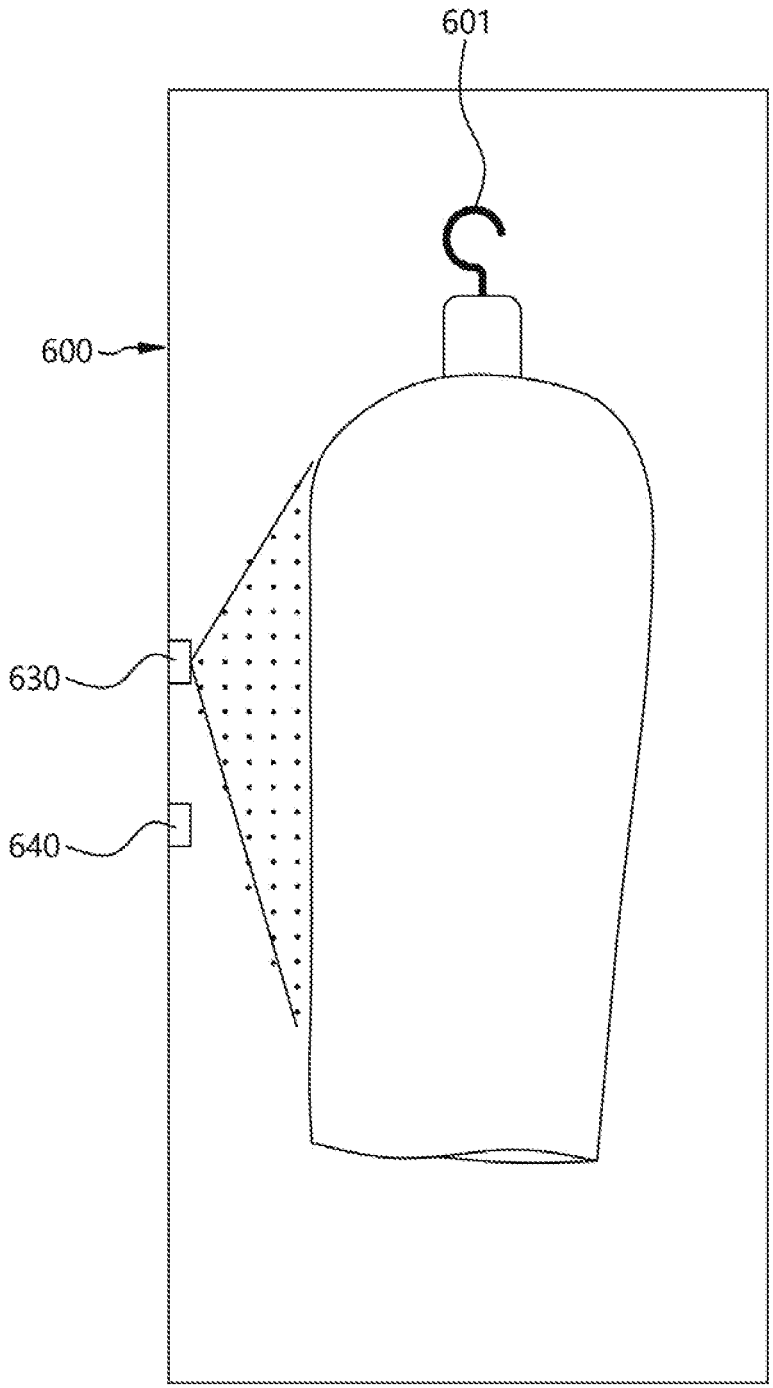

That is, as illustrated in FIGS. 20 and 21, the discharge angle (i.e., the discharge range) of the disinfectant discharge nozzle 630 may be changed according to the width of clothing, such that a disinfectant is discharged toward as the wide portion of the associated clothing as possible. In this case, the disinfectant discharge nozzle 630 may be configured to adjust the discharge angle by manipulation or may be configured to adjust the discharge angle by automatic control.

In addition, at least one distance sensor 640 which measures a distance between the disinfectant discharge nozzle 630 and the item may be provided on the inner surface of the function module 600. That is, the disinfectant discharge nozzle 630 may be configured such that after the distance sensor 640 senses a distance between the disinfectant discharge nozzle 630 and item (e.g., clothes), the discharge angle of the disinfectant discharge nozzle 630 is automatically adjusted according to the sensed distance. In this case, the distance sensor 640 may be configured as various sensors, such as an ultrasonic sensor and an optical sensor or the like.

In addition, the disinfectant discharge nozzle 630 may be configured to receive a disinfectant stored in a disinfectant storage tank 222 and to discharge the disinfectant. In this case, the disinfectant storage tank 222 may be installed in the filter housing 220 of the air management module 200. That is, the filter housing 220 may be configured such that a user can selectively open the filter housing 220 for the replacement of the filter 221 and for adding disinfectant to the disinfectant storage tank 222, so the user may easily replace the filter 221 by installing the disinfectant storage tank 222 in the filter housing 220.

The disinfectant may be hypochlorous acid water, or may be any other known type of disinfectant.

Figure 22:
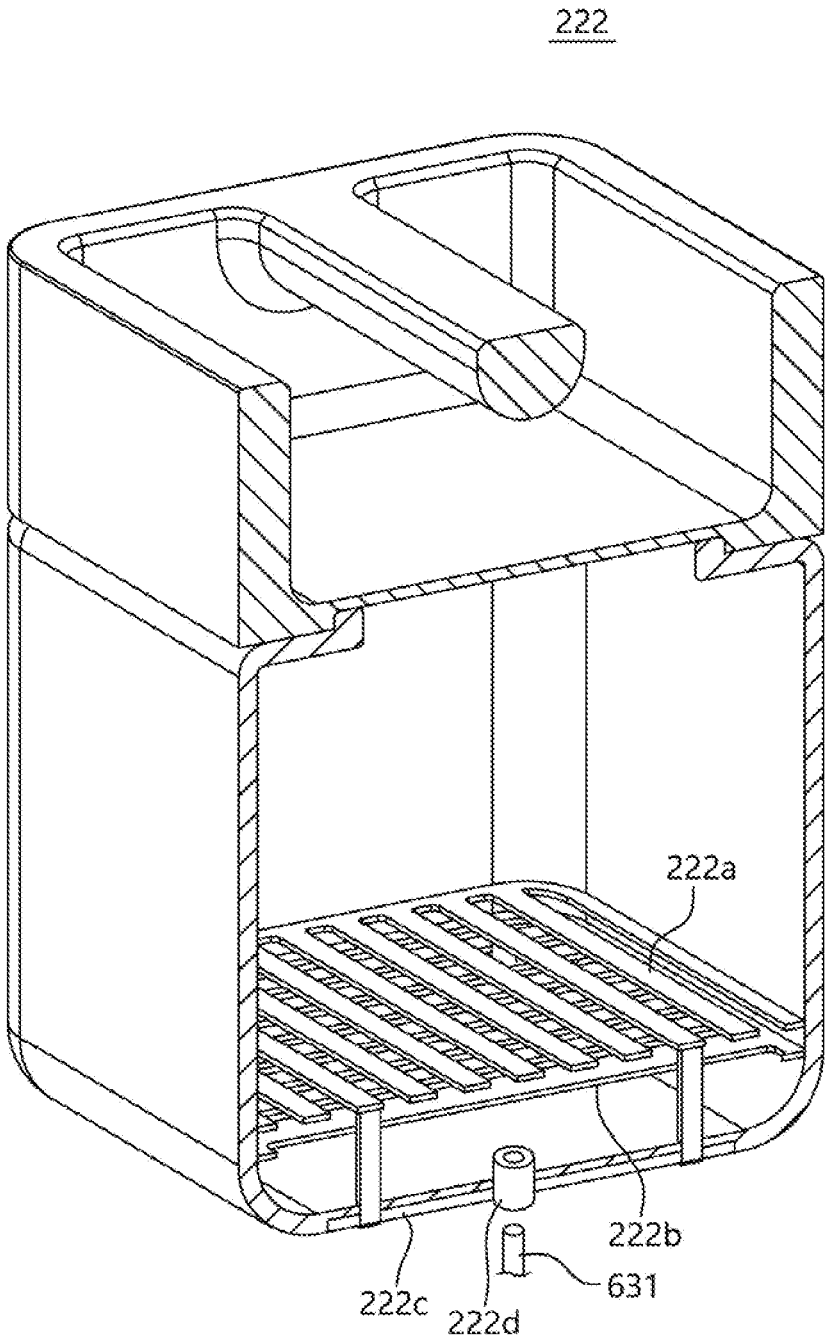
FIG. 22 is a cut-away perspective view illustrating a disinfectant storage tank of the hygiene management device for an entrance hall according to an embodiment of the present invention.
Figure 23:
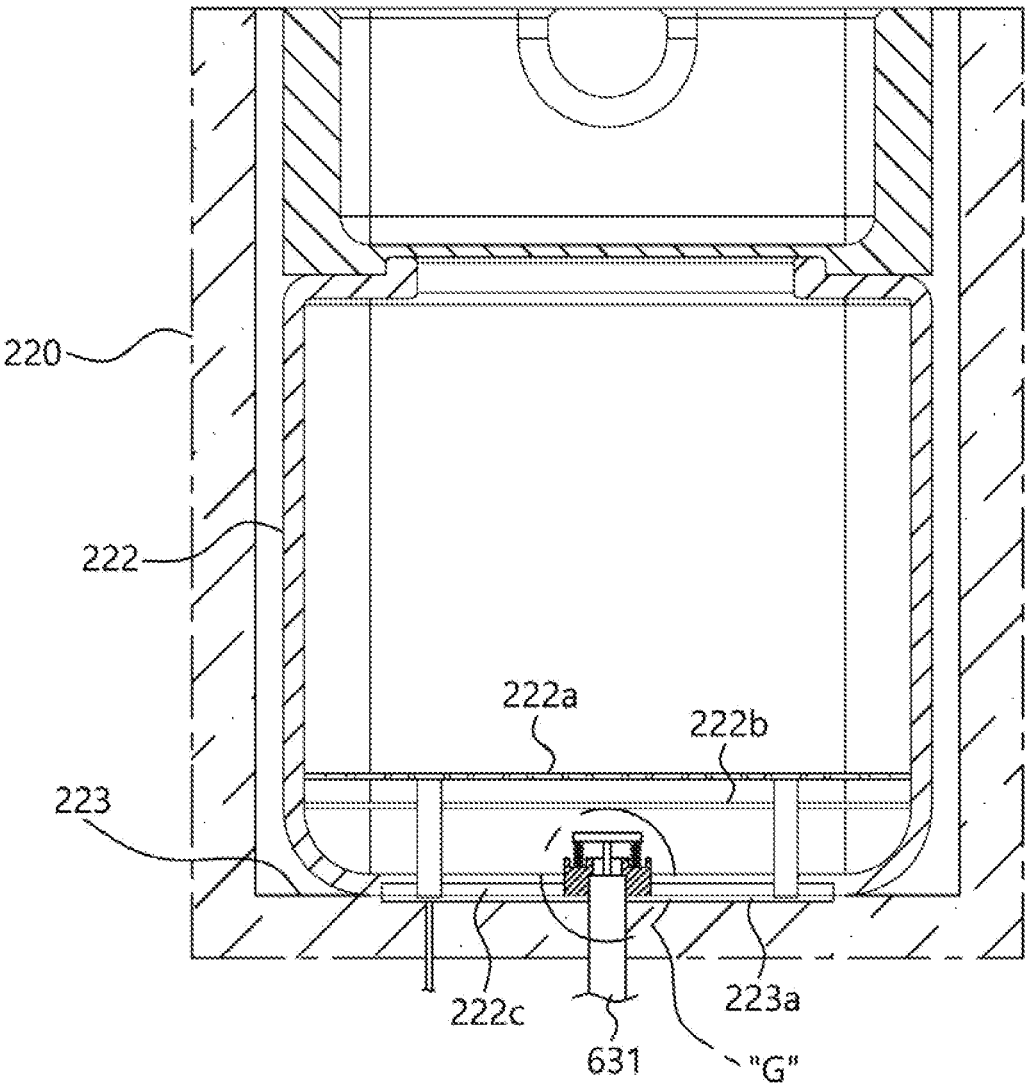
FIG. 23 is a sectional view of the installed state of the disinfectant storage tank of the hygiene management device for an entrance hall according to an embodiment of the present invention.

FIG. 22 illustrates the exterior of the disinfectant storage tank 222, and FIG. 23 illustrates the internal structure of the disinfectant storage tank 222. As illustrated in these drawings, two electrode plates 222*a* and 222*b* having poles different from each other for generating hypochlorous acid water may be provided in the disinfectant storage tank 222. In the two electrode plates 222*a* and 222*b* (e.g., at least one first electrode plate 222*a* and at least one second electrode plate 222*b*), the first electrode plate 222*a* having a positive pole may be configured to be connected to an external power source through a contact point 222*c* provided on the bottom of the disinfectant storage tank 222.

Particularly, a mounting groove 223 to which the disinfectant storage tank 222 is mounted may be formed in the filter housing 220, and a conductive plate 223*a* electrically conductive to (e.g., in electrical contact with) the contact point 222*c* of the disinfectant storage tank 222 may be provided on the bottom of the inside of the mounting groove 223, wherein the conductive plate 223*a* may be configured to be connected to the external power source.

In addition, the disinfectant storage tank 222 and the disinfectant discharge nozzle 630 may be connected to each other by a connection pipe 631. That is, a disinfectant stored in the disinfectant storage tank 222 may be supplied through the connection pipe 631 to the disinfectant discharge nozzle 630.

In this case, the connection pipe 631 may be installed along the wall surface of the filter housing 220. This is illustrated in FIG. 18.

Particularly, the disinfectant storage tank 222 and the connection pipe 631 may be configured to be connected to each other by a coupler 222*d*.

For example, the coupler 222*d* may be provided on the lower surface of the disinfectant storage tank 222, and the connection pipe 631 may be configured to protrude through the bottom of the inside of the mounting groove 223. That is, when mounting the disinfectant storage tank 222 to the mounting groove 223, the coupler 222*d* and the connection pipe 631 may be connected to each other, and when removing the disinfectant storage tank 222 from the mounting groove 223, the coupler 222*d* and the connection pipe 631 may be separated from each other.

Figure 24:
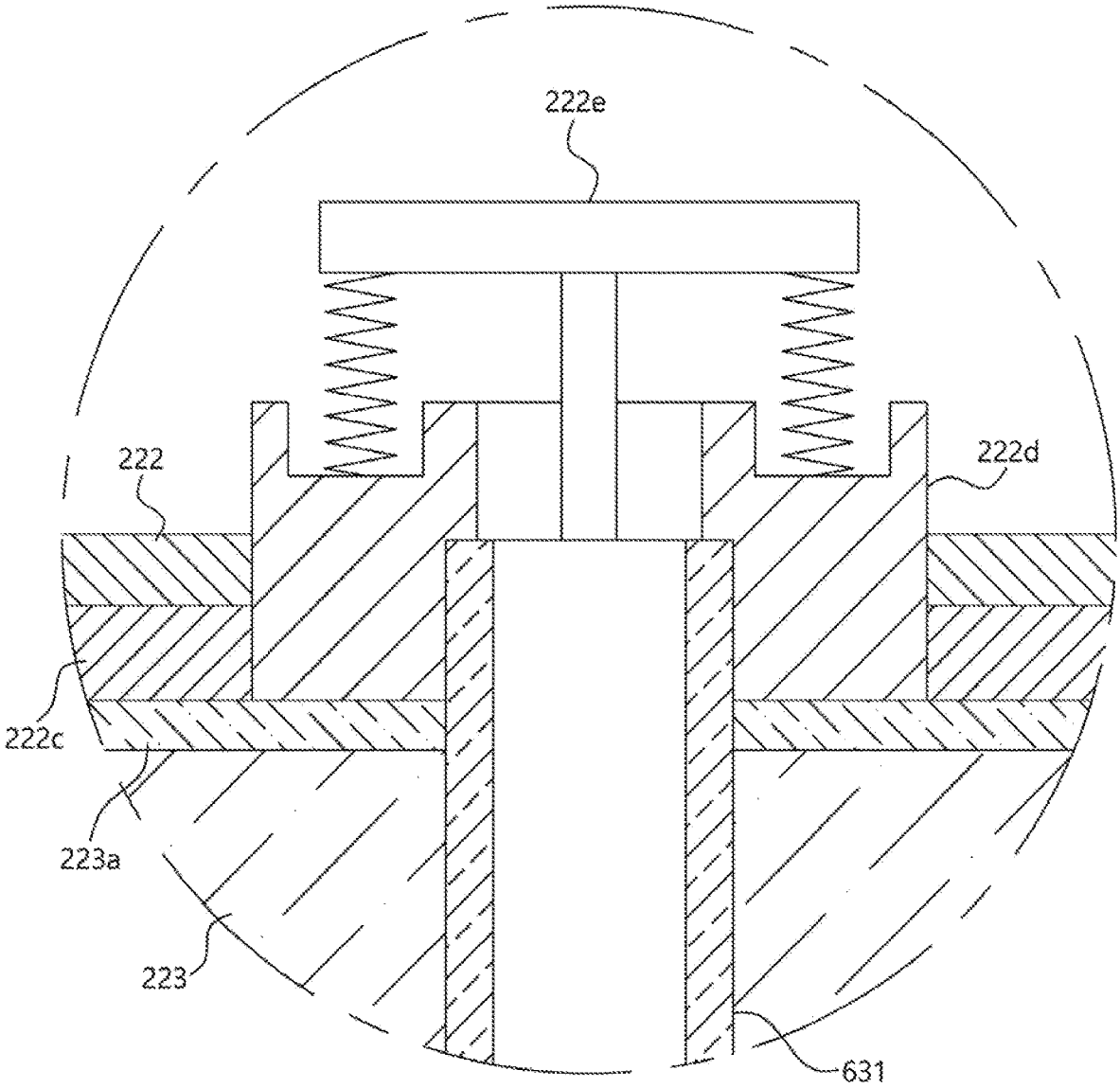
FIG. 24 is an enlarged view of a "G" part of FIG. 23.
Figure 25:
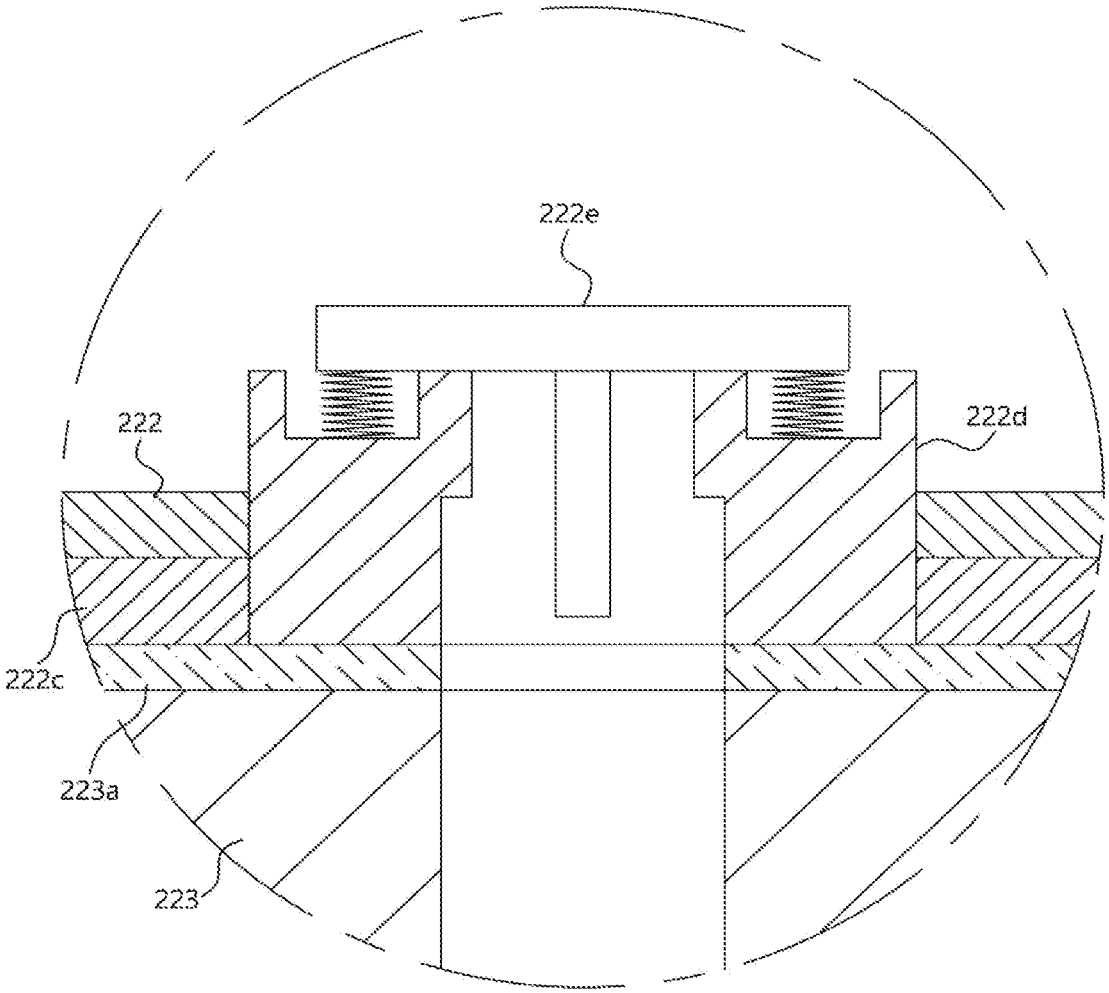
FIG. 25 is a view illustrating the operation of a valve of FIG. 24.

The coupler 222*d* may include a valve 222*e*. The valve 222*e* may be configured to open a flow path (the coupler) by being pressed by the connection pipe 631 and to close the flow path by being elastically restored to an initial position when the connection pipe 631 is separated from the coupler 222*d*. This is illustrated in FIGS. 24 and 25.

Figure 26:
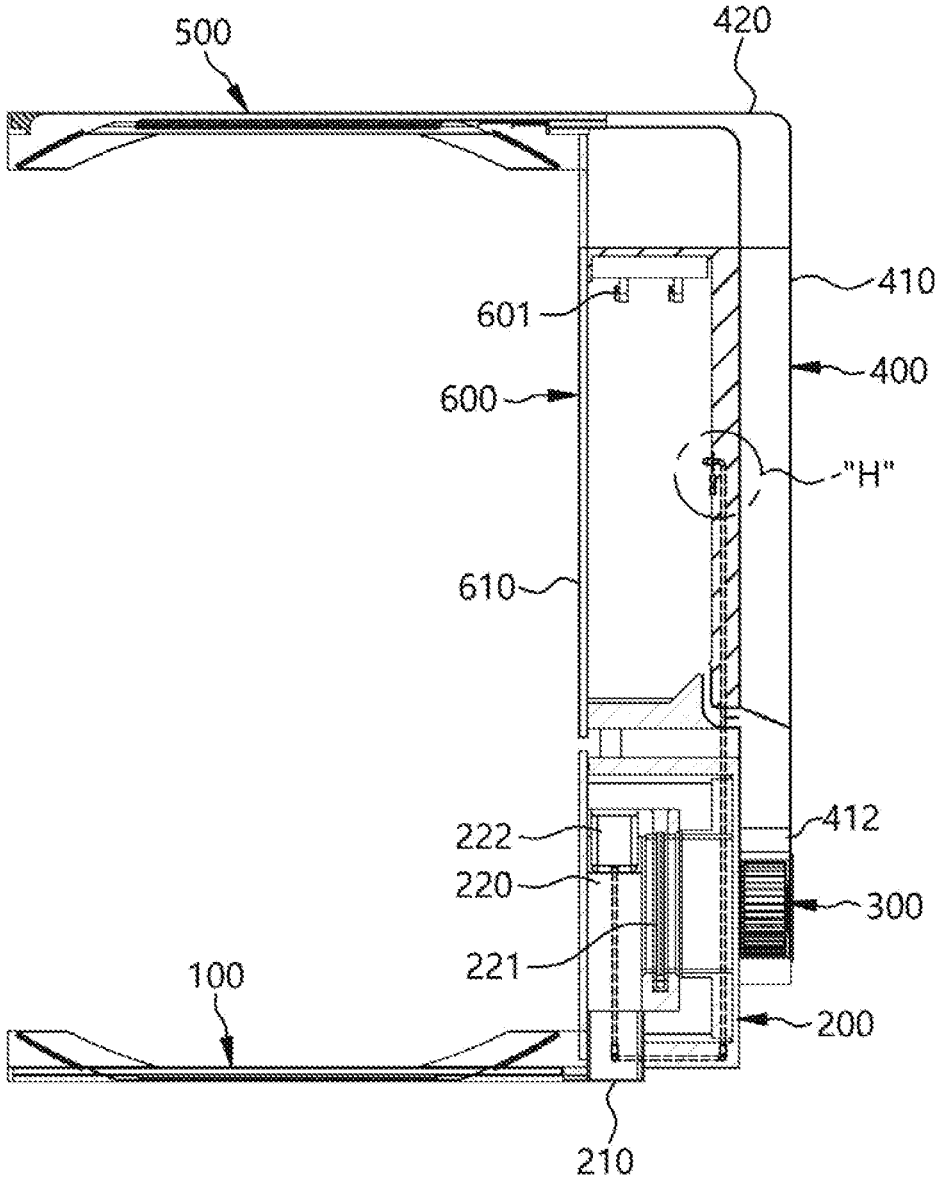
FIG. 26 is a sectional view of a state in which the disinfectant discharge nozzle is mounted to the rear wall surface of a function module in the hygiene management device for an entrance hall according to an embodiment of the present invention.
Figure 27:
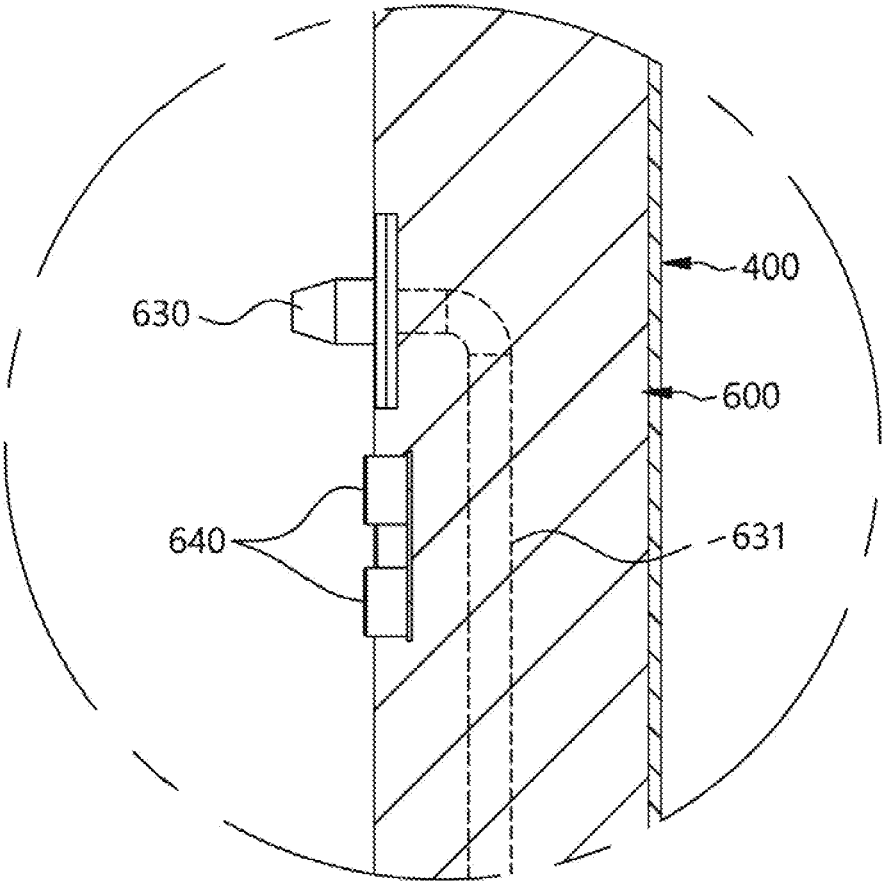
FIG. 27 is an enlarged view of an "H" part of FIG. 26.

Meanwhile, as illustrated in FIGS. 26 and 27, the disinfectant discharge nozzle 630 may be provided on the rear wall surface (a wall surface at a side opposite to a wall surface on which the door is installed) of the function module 600.

For example, when the front or back portion of clothing is directed to the front wall surface (the inner surface of the door) of the function module 600 or the rear wall surface of the of the function module 600, the disinfectant discharge nozzle 630 may be provided on the rear wall surface of the function module 600.

That is, it is preferable that the disinfectant discharge nozzle 630 is located on a wall surface facing the wide area of clothes such that the sterilization range of the clothes can be increased.

Of course, the disinfectant discharge nozzle 630 may be provided on the inner surface of the door 610.

The hygiene management device for an entrance hall according to still another embodiment of the present disclosure may be configured such that air in an entrance space is introduced through the footrest 100 into the air management module 200. That is, dust or foreign matter falling down to the footrest 100 from a person may not be accumulated on the footrest 100, but may be immediately removed by the at least one filter 221.

Particularly, when a portion through which air is introduced into the air management module 200 is configured as one edge portion in the entrance space, an air flow may be generated toward the associated edge portion and thus only a little air may flow toward an edge portion at a side opposite to the one edge portion.

That is, when a person is located at a portion of the upper surface of the footrest 100 which is far from the air management module 200, the effect of air shower on the person may decrease compared to when the person is located at a portion close to the air management module 200.

Figure 28:
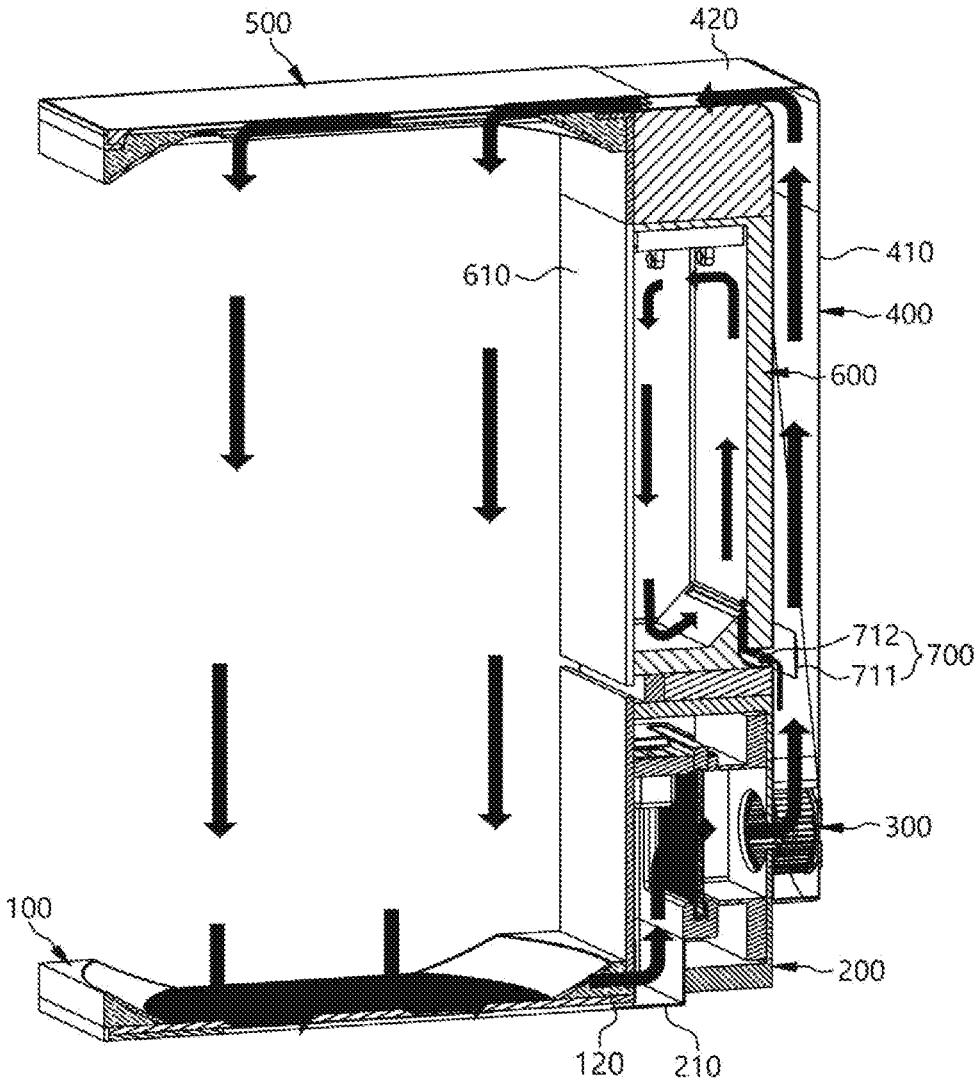
FIG. 28 is a view illustrating a state in which air is introduced into a footrest of the hygiene management device for an entrance hall according to still an embodiment of the present invention.

In consideration of this, as illustrated in FIG. 28, it is preferable that the flow of air introduced into the footrest 100 is generated such that regardless of a person's position, air can be discharged evenly toward the entire portion of the footrest 100 as much as possible.

Figure 29:
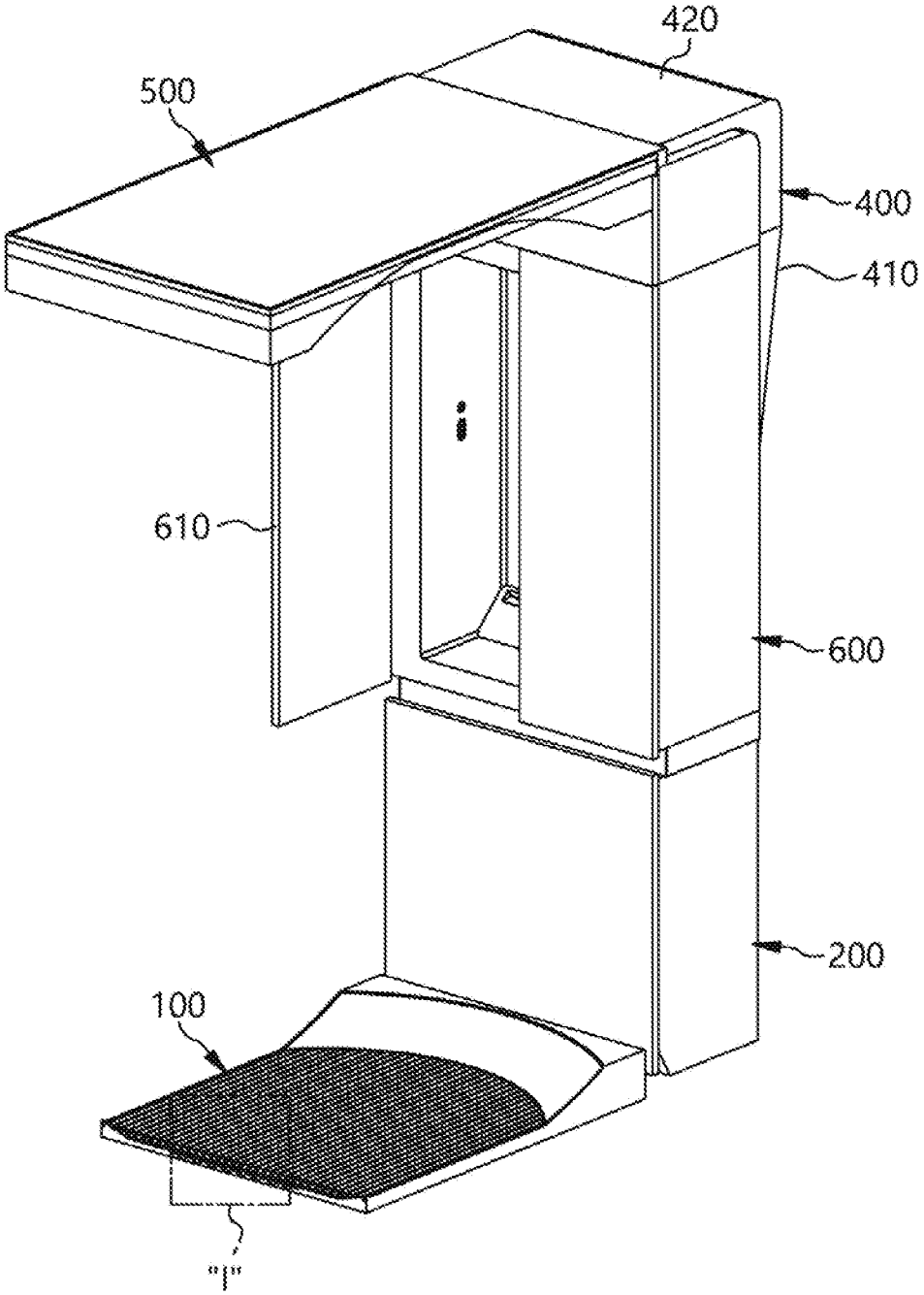
FIG. 29 is a cut-away perspective view of the footrest of the hygiene management device for an entrance hall according to an embodiment of the present invention from which the footrest is cut.
Figure 30:
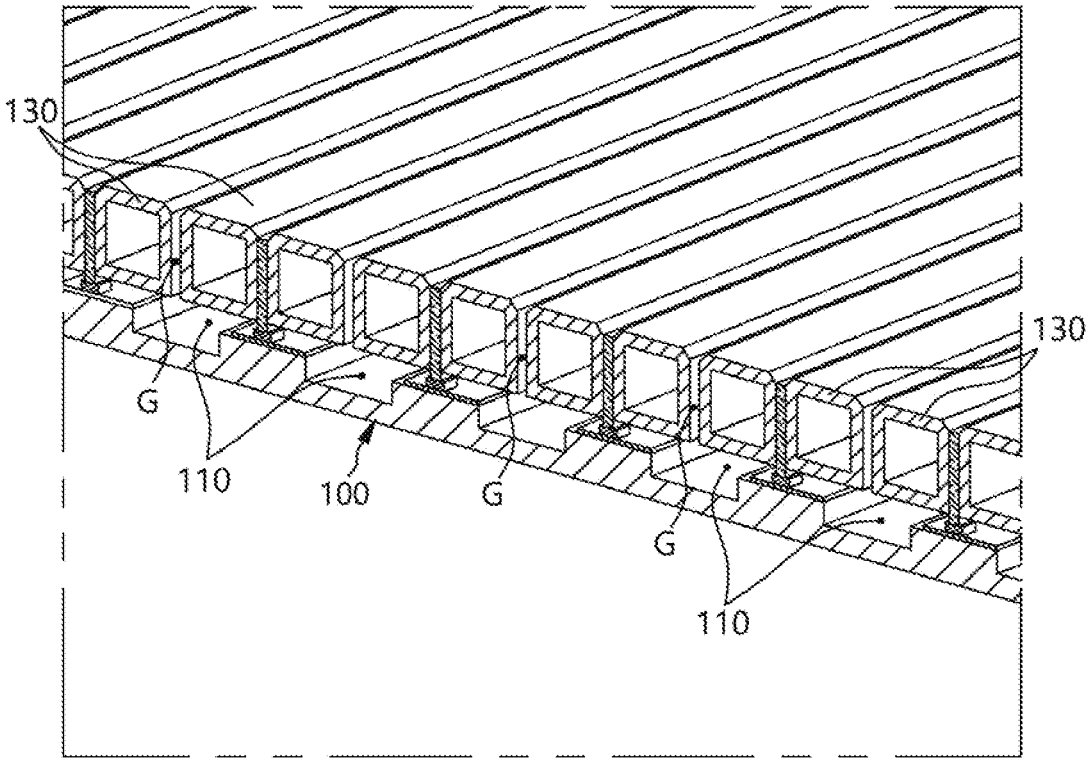
FIG. 30 is an enlarged view of an "I" part of FIG. 29.

FIG. 30 is an enlarged view of an "I" part of FIG. 29, in which the footrest 100 is cut (i.e., a sectional view). To this end, as illustrated in FIG. 30, a plurality of introduction flow paths 110 may be formed in the upper surface of the footrest 100. Each of the introduction flow paths 110 may be configured to guide an air flow toward a position at which the introduction duct 210 of the air management module 200 is located.

The air inlet of the introduction duct 210 may be connected to each of the introduction flow paths 110 through the periphery of the footrest 100, such that an air inlet of the introduction duct 210 communicates with each of the introduction flow paths 110. In this case, a communication flow path 120 (see FIG. 28) may be formed at the periphery of the footrest 100, each of the introduction flow paths 110 may be configured to communicate with the communication flow path 120, and the introduction duct 210 may be connected to the communication flow path 120.

In addition, a plurality of lower support bars 130 (e.g., support bars) may be installed on the upper surface of the footrest 100.

The lower support bars 130 may include multiple lower support bars, and may be installed to be parallel to the introduction flow paths 110 formed in the upper surface of the footrest 100.

Each of the lower support bars 130 may be configured as a rectangular tube having a rectangular cross-section. That is, the lower support bars 130 may have a hollow shape, thereby ensuring durability against external forces and reducing the entire weight of the footrest 100. However, the lower support bars 130 may have any shape.

Particularly, the lower support bars 130 may be disposed to be spaced apart from each other, and the introduction flow path 110 may be installed to be located at a lower portion of a gap between each of the lower support bars 130. That is, dust or foreign matter falling down from a person may pass through a gap G between each of the lower support bars 130, and together with air, may be supplied to the introduction flow path 110.

Accordingly, the hygiene management device for an entrance hall of the present disclosure may be embodied in various forms.

Various embodiments described herein may be implemented in a computer-readable medium using, for example, software, hardware, or some combination thereof. For example, the embodiments described herein may be implemented within one or more of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, other electronic units designed to perform the functions described herein, or a selective combination thereof. In some cases, such embodiments are implemented by the controller. That is, the controller is a hardware-embedded processor executing the appropriate algorithms (e.g., flowcharts) for performing the described functions and thus has sufficient structure. Also, the embodiments such as procedures and functions may be implemented together with separate software modules each of which performs at least one of functions and operations. The software codes can be implemented with a software application written in any suitable programming language. Also, the software codes can be stored in the memory and executed by the controller, thus making the controller a type of special purpose controller specifically configured to carry out the described functions and algorithms. Thus, the components shown in the drawings have sufficient structure to implement the appropriate algorithms for performing the described functions.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A hygiene management device for an entrance hall, the hygiene management device comprising:
- a fan assembly configured to generate a flow of air;
- a duct unit configured to receive air flow from the fan assembly;
- an air discharger configured to:
  - receive air from the duct unit; and
  - discharge the received air toward a person; and
- a function module including:
  - a storage space;
  - an inflow path configured to receive air from the duct unit, the inflow path including an air inlet and an air outlet; and
  - an opening/closing unit configured to:
    - selectively open or close air flow to the function module; and
    - selectively open or close air flow to the duct unit,
- wherein the hygiene management device has an upper part provided on an upper portion of the entrance hall and defined as an upper wall, a bottom part provided on a floor of the entrance hall and defined as a lower wall, and a sidewall part provided on a side of the entrance hall and defined as a side wall,
- wherein the fan assembly is provided at a lower portion of the sidewall part,
- wherein the function module is provided at an upper portion of the sidewall part,
- wherein the air discharger is provided in the upper part,
- wherein the duct unit includes:
  - a first duct provided along a rear of the function module in the sidewall part and connected to the fan assembly, and
  - a second duct provided on an upper portion of the function module and receiving air passing through the first duct and supplying the received air to the air discharger,
- wherein the air inlet of the inflow path is formed through a rear surface of the function module so as to communicate with an inside of the first duct, and
- wherein the air outlet of the inflow path opens into an inside of the function module,
- wherein the opening/closing unit includes:
  - a first shutter located in the first duct; and
  - a second shutter located in the inflow path,
- wherein the first shutter is configured to open both the first duct and a communication portion of the inflow path, or to open only the inflow path, and
- wherein the second shutter selectively closes the inflow path regardless of whether the first duct is open.

2. The hygiene management device of claim 1, wherein the function module includes:
- a door; and
- a disinfectant discharge nozzle, the disinfectant discharge nozzle being configured to discharge a disinfectant towards an item stored in the storage space.

3. The hygiene management device of claim 2, wherein a discharge angle of the disinfectant discharge nozzle is configured to be automatically adjusted according to a distance between the disinfectant discharge nozzle and the item stored in the storage space.

4. The hygiene management device of claim 3, wherein the function module further includes a distance sensor configured to measure the distance between the disinfectant discharge nozzle and the item stored in the storage space.

5. The hygiene management device of claim 4, further comprising a disinfectant storage tank configured to supply disinfectant to the disinfectant discharge nozzle, wherein the disinfectant storage tank includes a first electrode plate and a second electrode plate, the first electrode plate and the second electrode plate having poles different from each other, and wherein the first electrode plate and the second electrode plate are configured to generate hypochlorous acid water.

6. The hygiene management device of claim 5, further comprising an air management module located at an air introduction side of the fan assembly, the air management module including a filter housing, wherein the disinfectant storage tank is removably attached to the filter housing.

7. The hygiene management device of claim 1, wherein the bottom part includes:

a footrest facing the air discharger and defining a bottom of the hygiene management device, the footrest including introduction flow paths configured to receive air discharged from the air discharger; and an air management module provided in front of the fan assembly in the lower portion of the sidewall part, and wherein the air management module is configured to:

filter air received from the footrest; and guide the filtered air to the fan assembly.

8. The hygiene management device of claim 1, wherein the fan assembly is located below the function module, and wherein a lower end of the duct unit is connected to the fan assembly, and an upper end of the duct unit is connected past the function module to the air discharger.

9. The hygiene management device of claim 1, wherein a rear edge of the inside of the function module is inclined and is located at a position higher than a bottom surface of the inside of the function module, and wherein the air outlet of the inflow path is formed in the inclined rear edge of the function module.

10. The hygiene management device of claim 1, wherein the inflow path includes:

the air inlet in fluid communication with the duct unit; and the air outlet disposed in the storage space of the function module, and wherein the second shutter is configured to open/close at least one portion of the air inlet and the air outlet of the inflow path.

11. A hygiene management device, comprising:

a fan assembly configured to generate a flow of air;

a duct unit configured to receive air flow from the fan assembly;

an air discharger configured to:

receive air from the duct unit; and discharge the received air toward a person; and a function module including:

a storage space; and a disinfectant discharge nozzle, the disinfectant discharge nozzle being configured to discharge a disinfectant toward an item stored in the storage space;

an inflow path configured to receive air from the duct unit, the inflow path including an air inlet and an air outlet; and an opening/closing unit configured to:

selectively open or close air flow to the function module; and selectively open or close air flow to the duct unit a distance sensor configured to measure a distance between the disinfectant discharge nozzle and the stored item, wherein the disinfectant discharge nozzle is configured to automatically adjust a discharge angle according to the distance between the disinfectant discharge nozzle and the stored item, wherein the duct unit includes:

a first duct provided along a rear of the function module in a sidewall part and connected to the fan assembly, and a second duct provided on an upper portion of the function module and receiving air passing through the first duct and supplying the received air to the air discharger, wherein the air inlet of the inflow path is formed through a rear surface of the function module so as to communicate with an inside of the first duct, wherein the air outlet of the inflow path opens into an inside of the function module, wherein the opening/closing unit includes:

a first shutter located in the first duct; and a second shutter located in the inflow path, wherein the first shutter is configured to open both the first duct and a communication portion of the inflow path, or to open only the inflow path; and wherein the second shutter selectively closes the inflow path regardless of whether the first duct is open.

12. The hygiene management device of claim 11, wherein the inflow path includes:

the air inlet in fluid communication with the duct unit; and the air outlet disposed in the storage space of the function module, and wherein the second shutter is configured to open/close at least one portion of the air inlet and the air outlet of the inflow path.

13. The hygiene management device of claim 11, further comprising a disinfectant storage tank configured to supply disinfectant to the disinfectant discharge nozzle, wherein the disinfectant storage tank includes a first electrode plate and a second electrode plate, the first electrode plate and the second electrode plate having poles different from each other, and wherein the first electrode plate and the second electrode plate are configured to generate hypochlorous acid water.

14. The hygiene management device of claim 11, further comprising:

a footrest facing the air discharger and defining a bottom of the hygiene management device, the footrest including introduction flow paths configured to receive air discharged from the air discharger; and an air management module configured to:

filter air received from the footrest; and guide the filtered air to the fan assembly.

15. The hygiene management device of claim 11, wherein a rear edge of the inside of the function module is inclined and is located at a position higher than a bottom surface of the inside of the function module, and wherein the air outlet of the inflow path is formed in the inclined rear edge of the function module.

16. The hygiene management device of claim 11, wherein the disinfectant discharge nozzle is disposed on a wall of the function module.

* * * * *